US010062498B2

(12) United States Patent
Chuang

(10) Patent No.: US 10,062,498 B2
(45) Date of Patent: Aug. 28, 2018

(54) COMPOSITE MAGNETIC COMPONENT

(71) Applicant: CYNTEC CO., LTD., Hsinchu (TW)

(72) Inventor: Chia-Cheng Chuang, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 12 days.

(21) Appl. No.: 14/840,405

(22) Filed: Aug. 31, 2015

(65) Prior Publication Data

US 2016/0064139 A1 Mar. 3, 2016

Related U.S. Application Data

(60) Provisional application No. 62/044,435, filed on Sep. 2, 2014.

(51) Int. Cl.

| | |
|---|---|
| ***H01F 27/28*** | (2006.01) |
| ***H01F 17/06*** | (2006.01) |
| ***H01F 19/08*** | (2006.01) |
| ***H01F 38/02*** | (2006.01) |
| *H01F 17/00* | (2006.01) |

(52) U.S. Cl.

CPC ..... *H01F 27/2895* (2013.01); *H01F 17/062* (2013.01); *H01F 19/08* (2013.01); *H01F 27/2823* (2013.01); *H01F 38/02* (2013.01); *H01F 2017/0093* (2013.01)

(58) Field of Classification Search

CPC .... H01F 27/2895; H01F 19/08; H01F 17/062; H01F 27/385; H01F 2017/0093; H01F 17/04; H01F 17/06; H01F 27/38; H01F 38/02; H01F 27/2823

USPC ..... 336/188, 214, 170

See application file for complete search history.

(56) References Cited

U.S. PATENT DOCUMENTS

| | | | | |
|---|---|---|---|---|
| 2,406,045 | A * | 8/1946 | Stevens | H01F 27/38 336/184 |
| 3,679,966 | A * | 7/1972 | Wanlass | G05F 3/06 336/170 |
| 5,923,237 | A * | 7/1999 | Sato | H03H 7/42 336/192 |
| 6,215,386 | B1 * | 4/2001 | Gokita | H01F 17/06 336/188 |
| 6,323,637 | B1 | 11/2001 | Ayres et al. | |

(Continued)

FOREIGN PATENT DOCUMENTS

| | | |
|---|---|---|
| CN | 87200667 | 5/1988 |
| CN | 103460309 | 12/2013 |

(Continued)

*Primary Examiner* — Elvin G Enad
*Assistant Examiner* — Malcolm Barnes
(74) *Attorney, Agent, or Firm* — Kirton McConkie; Evan R. Witt

(57) ABSTRACT

A composite magnetic component is provided. The composite magnetic component includes a magnetic flux-guiding unit, a first coil structure and a second coil structure. The first coil structure and the second coil structure are wound around a first winding portion and a second winding portion of the magnetic flux-guiding unit, respectively. A first magnetic flux results from the first coil structure and the magnetic flux-guiding unit. A second magnetic flux results from the second coil structure and the magnetic flux-guiding unit. The first magnetic flux is orthogonal to the second magnetic flux within the magnetic flux-guiding unit.

5 Claims, 21 Drawing Sheets

(56) References Cited

U.S. PATENT DOCUMENTS

| | | | | |
|---|---|---|---|---|
| 2002/0021201 | A1* | 2/2002 | Ol | H01F 3/14 336/197 |
| 2002/0084878 | A1* | 7/2002 | Kimura | H01F 17/045 336/83 |
| 2007/0040645 | A1* | 2/2007 | Sedio | H01F 19/06 336/232 |
| 2009/0230776 | A1* | 9/2009 | Ochi | H01F 27/38 336/216 |
| 2013/0009737 | A1* | 1/2013 | Rocke | H01F 29/14 336/5 |
| 2015/0162121 | A1* | 6/2015 | Lee | H01F 27/2823 336/65 |
| 2016/0133377 | A1* | 5/2016 | Takagi | H01F 27/2823 336/192 |

FOREIGN PATENT DOCUMENTS

| | | |
|---|---|---|
| JP | 2000-40626 | 2/2000 |
| WO | 01/90835 | 11/2001 |

* cited by examiner

COMPOSITE MAGNETIC COMPONENT

CROSS-REFERENCE TO RELATED APPLICATIONS

The present application is a nonprovisional application claiming benefit from a prior-filed provisional application bearing a Ser. No. 62/044,435 and filed Sep. 2, 2014, the entity of which is incorporated herein for reference.

FIELD OF THE INVENTION

The present disclosure relates to a magnetic component, and particularly to a composite magnetic component.

BACKGROUND OF THE INVENTION

Nowadays, local area networks (LAN) are widely applied to many areas e.g. home, office, school, laboratory and building. Many electronic devices such as personal computers, workstations, printers and servers are in communication with each other through the local area networks. Therefore, huge data are transmitted through LAN cables. Pulse transformers and common-mode filters are usually required at the interfaces between the LAN cables and the electronic devices.

Please refer to FIG. 1, an equivalent circuit diagram of a pulse transformer and a common-mode filter. The pulse transformer 11*a* provides direct-current blocking function between the physical side of the electronic device and the connected LAN cable. The pulse transformer 11*a* can keep transmission quality and reduce signal distortion of high speed digital signals.

At first, since there may exist potential difference (voltage) between the LAN cable and the electronic device, direct contact with the LAN cable may cause damage of the electronic device. Therefore, it is required to block direct current between the LAN cable and the electronic device, while alternating-current signals are allowed to be transmitted through the LAN cable. Furthermore, the physical side includes microelectronic circuits for signal modulation and demodulation and they are very sensitive to surge voltage/current. Impact resulting from the surge voltage/current may cause malfunction, damage even fire accident. In addition, surge voltage/current may occur because the LAN cables are exposed to the environment and bear temperature change, electric shock and wiring work. Effective protection against the surge can be achieved by using the pulse transformer 11*a* with direct-current blocking function.

Furthermore, in a differential pair, external electromagnetic interference affects both conductors of the differential pair so as to generate in-phase noises, e.g. common-mode noises. Moreover, direct-current interference introduced through a common ground or a power supply terminal may cause common-mode noises in the conductors. In addition to the pulse transformer 11*a*, the common-mode filter 12*a* can further suppress the common-mode noises. Furthermore, parasitic capacitance usually exists between both coils of the pulse transformer 11*a*. The common-mode noises at higher frequency entering one side of the pulse transformer 11*a* will be transmitted to the other side due to parasitic coupling effects. The common-mode filter 12*a* is useful to remove the high frequency noises.

Please refer to FIG. 1 again. The pulse transformer 11*a* and the neighboring common-mode filter 12*a* are arranged in a signal path. Both the pulse transformer 11*a* and the common-mode filter 12*a* are formed by winding coils around magnetic (or iron) units. Each of the pulse transformer 11*a* and the common-mode filter 12*a* has its own magnetic unit and coils. Although the pulse transformer 11*a* together with the common-mode filter 12*a* can achieve direct-current blocking and common-mode noise suppression, they indeed occupy much space and have adverse effect on size reduction. In addition, production cost thereof also increases.

Furthermore, if the two magnetic elements 11*a* and 12*a* are disposed too close, magnetic coupling between them occurs and results in interference and electric defect. In particular, high operation frequency, e.g. 100~400 MHz in Gigabit Ethernet or higher transmission rate, makes the interference much worse. Therefore, it is difficult to balance electric property and size reduction of the magnetic component.

Accordingly, a composite magnetic component with reduced size while maintaining good electric and magnetic property is desired.

SUMMARY OF THE INVENTION

The present disclosure provides a composite magnetic component. The composite magnetic component includes a magnetic flux-guiding unit, a first coil structure and a second coil structure. The first coil structure and the second coil structure are wound around a first winding portion and a second winding portion of the magnetic flux-guiding unit, respectively. A first magnetic flux results from the first coil structure and the magnetic flux-guiding unit. A second magnetic flux results from the second coil structure and the magnetic flux-guiding unit. The first magnetic flux is orthogonal to the second magnetic flux within the magnetic flux-guiding unit.

Another aspect of the present disclosure provides a composite magnetic component. The composite magnetic component includes a magnetic flux-guiding unit, a first coil structure and a second coil structure. The first coil structure and the second coil structure are wound around a first winding portion and a second winding portion of the magnetic flux-guiding unit, respectively. A first magnetic flux results from the first coil structure and the magnetic flux-guiding unit. A second magnetic flux results from the second coil structure and the magnetic flux-guiding unit. The first magnetic flux and the second magnetic flux intersect at flux intersections within the magnetic flux-guiding unit. At least a portion of the first magnetic flux at the flux intersections is orthogonal to at least a portion of the second magnetic flux at the flux intersections.

BRIEF DESCRIPTION OF THE DRAWINGS

The advantages of the present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

According to the present disclosure, a composite magnetic component includes a magnetic flux-guiding unit, a first coil structure and a second coil structure, which may be integrated to a circuit board (not shown). The first coil structure and the second coil structure are wound around a first winding portion and a second winding portion of the magnetic flux-guiding unit, respectively. The first coil structure has a first center axis and the second coil structure has a second center axis. The term "center axis" means an imaginary line passing through centers of turns of the coil or coil structure. The first coil structure and the magnetic flux-guiding unit form a first magnetic element, while the second coil structure and the magnetic flux-guiding unit form a second magnetic element. The first magnetic element and the second magnetic element are electrically independent elements. Therefore, only one magnetic flux-guiding unit is required for providing two magnetic elements, thereby significantly reducing production cost and product size of the magnetic component.

In the description of the present disclosure, each of the first coil structure and the second coil structure may be implemented by a single coil or a plurality of coils. The present disclosure provides many types of the magnetic flux-guiding units and they are presented in the following embodiments.

Figure 1:
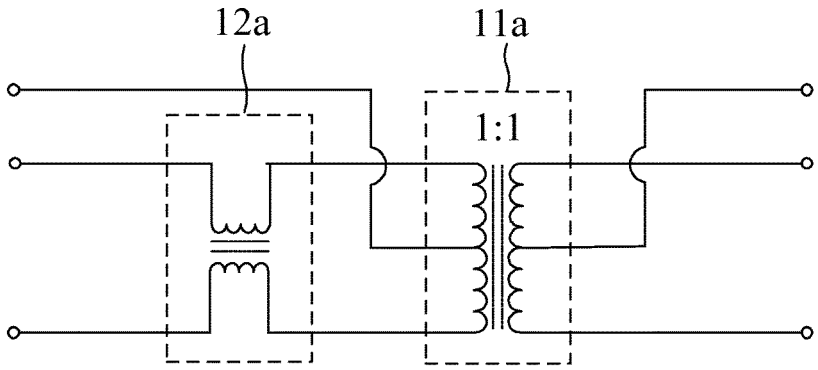
FIG. 1 (PRIOR ART)
FIG. 1 is an equivalent circuit diagram of a pulse transformer and a common-mode filter in the prior arts.
Figure 2:
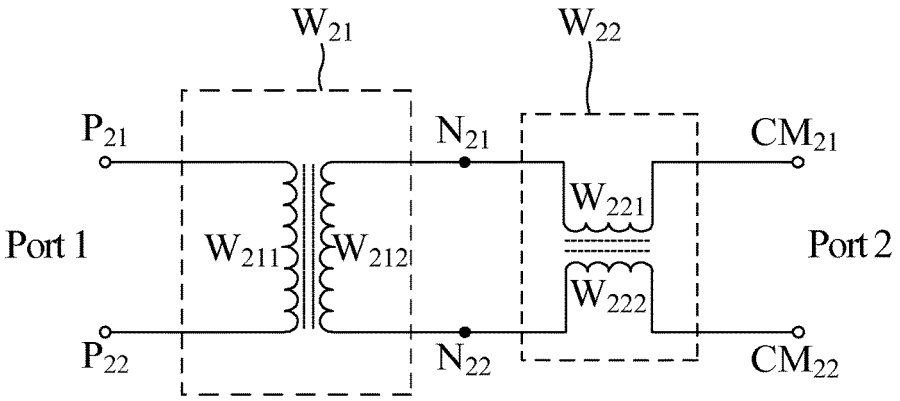
FIG. 2 is an equivalent circuit diagram of a composite magnetic component according to an embodiment of the present invention.

Please refer to FIG. 2, an equivalent circuit diagram of a composite magnetic component according to an embodiment of the present invention. The first coil structure $W_{21}$ includes a first coil $W_{211}$ and a second coil $W_{212}$, while the second coil structure $W_{22}$ includes a third coil $W_{221}$ and a fourth coil $W_{222}$. One end of the first coil $W_{211}$ is electrically connected to a first terminal $P_{21}$ of a first port (Port 1), and the other end is electrically connected to a second terminal $P_{22}$ of the first port (Port 1). One end of the second coil $W_{212}$ is electrically connected to a first node $N_{21}$, and the other end is electrically connected to a second node $N_{22}$. One end of the third coil $W_{221}$ is electrically connected to the first node $N_{21}$, and the other end is electrically connected to a first terminal $CM_{21}$ of a second port (Port 2). One end of the fourth coil $W_{222}$ is electrically connected to the second node $N_{22}$, and the other end is electrically connected to a second terminal $CM_{22}$ of the second port (Port 2). For example, the first coil $W_{211}$ and the second coil $W_{212}$ may be a primary winding and a secondary winding of a pulse transformer, respectively.

Figure 3A:
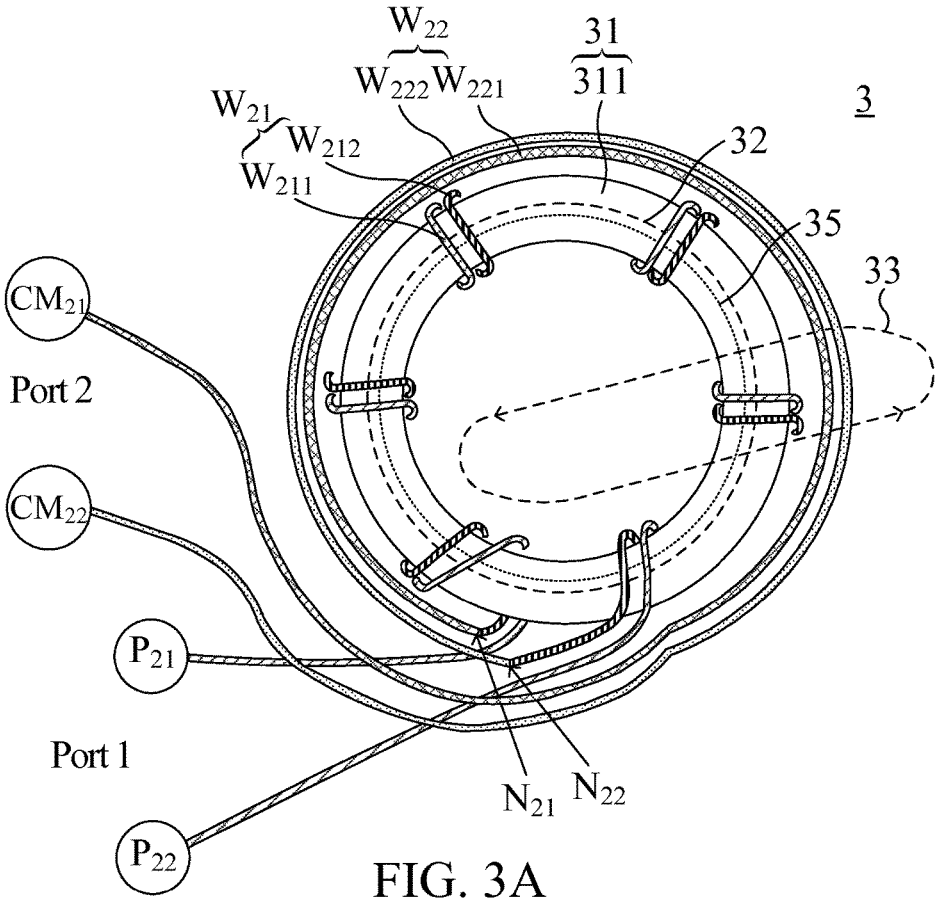
FIG. 3A is a schematic diagram illustrating a composite magnetic component meeting the equivalent circuit of FIG. 2.

Please refer to FIG. 3A, a schematic diagram illustrating a composite magnetic component which meets the equivalent circuit of FIG. 2. The composite magnetic component 3 includes a magnetic flux-guiding unit 31, a first coil structure $W_{21}$ and a second coil structure $W_{22}$. In this embodiment, the magnetic flux-guiding unit 31 is a toroidal core 311. The toroidal core 311 may be a square toroidal core, a ring toroidal core or a specific toroidal core whose cross section is a circle, a rectangle or a polygon. The first coil structure $W_{21}$ and the magnetic flux-guiding unit 31 form a first magnetic element, while the second coil structure $W_{22}$ and the magnetic flux-guiding unit 31 form a second magnetic element. The first magnetic element and the second magnetic element may be a pulse transformer and a common-mode filter, respectively, but the present disclosure is not limited thereto.

In particular, the first coil structure $W_{21}$ includes a first coil $W_{211}$ and a second coil $W_{212}$, while the second coil structure $W_{22}$ includes a third coil $W_{221}$ and a fourth coil $W_{222}$. The first coil structure $W_{21}$ and the second coil structure $W_{22}$ are wound around different winding portions of the toroidal core 311 to generate a first magnetic flux 32 and a second magnetic flux 33 wherein the center axes of the first coil structure $W_{21}$ and the second coil structure $W_{22}$ extend along different directions. The first magnetic element together with the first port (Port 1) is viewed as a one-port network, and so is the second magnetic element together with the second port (Port 2).

Figure 3B:
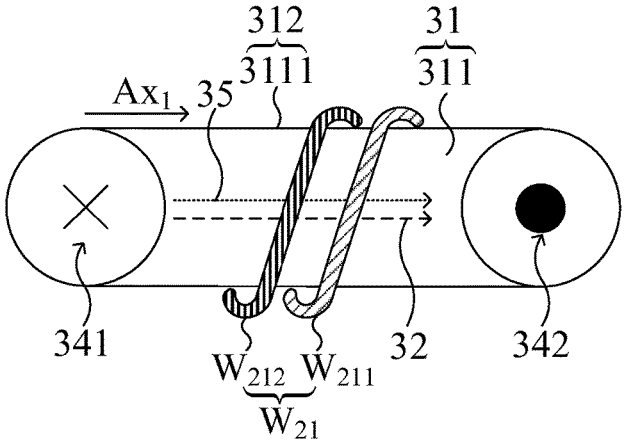
FIG. 3B is a schematic diagram illustrating the first magnetic flux generated by the composite magnetic component of FIG. 3A.

FIG. 3B shows the first magnetic flux 32 resulting from the first coil structure $W_{21}$ and the magnetic flux-guiding unit 31 of the composite magnetic component 3. The first coil structure $W_{21}$ is radially wound around a first winding portion 312 and has a first center axis $Ax_1$ extending along a tangential direction (circumferential direction) of the toroidal core 311. The entire first center axis $Ax_1$ is within the toroidal core 311 and has a ring shape. In other words, the first magnetic flux 32 flows along the circumferential direction of the toroidal core 311. In a segment of the toroidal core 311, the first magnetic flux 32 enters the segment through a cross-section 341 (circle with cross), flows along the toroidal core 311, and goes out through the other cross-section 342 (circle with dot). The first magnetic paths 35 are confined in the toroidal core 311. In particular, the first magnetic paths 35 are closed loops and have a shape consistent with the outline shape of the toroidal core 311.

Figure 3C:
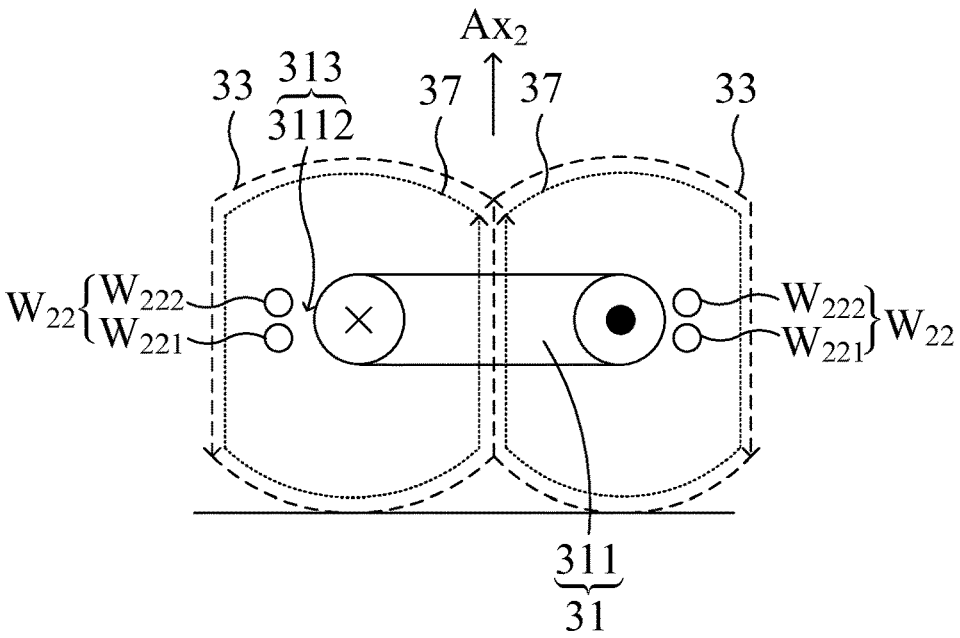
FIG. 3C is a schematic diagram illustrating the second magnetic flux generated by the composite magnetic component of FIG. 3A.

FIG. 3C shows the second magnetic flux 33 resulting from the second coil structure $W_{22}$ and the magnetic flux-guiding unit 31 of the composite magnetic component 3. The second coil structure $W_{22}$ is circumferentially wound around the second winding portion 313 and has a second center axis $Ax_2$ consistent with the symmetry axis of the toroidal core 311. Therefore, the second magnetic flux 33 flows around the cross-sections of the second coil structure $W_{22}$. In particular, the second magnetic flux 33 passes through the toroidal core 311 perpendicularly. The second magnetic paths 37 are closed loops, only sections of which are present within the toroidal core 311.

Figure 3D:
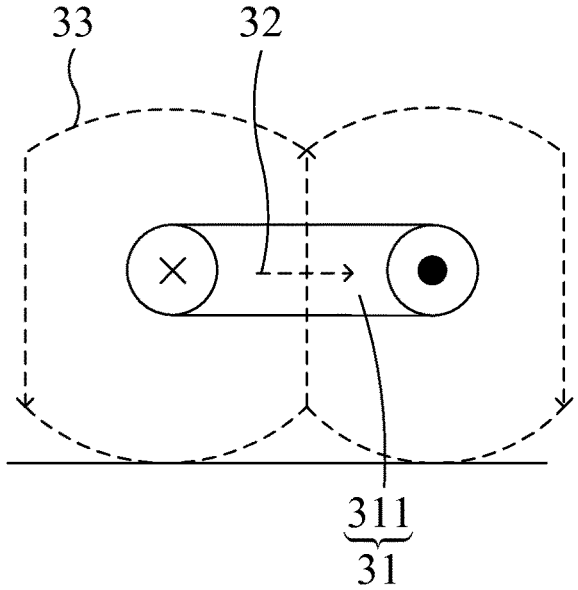
FIG. 3D is a schematic diagram illustrating the first magnetic flux and the second magnetic flux relative to the magnetic flux-guiding unit of the composite magnetic component of FIG. 3A.

As shown in FIG. 3B and FIG. 3C, the first winding portion 312 includes a toroidal body 3111 of the toroidal core 311 and the second winding portion 313 includes an outer margin (outer circumference) 3112. The first center axis $Ax_1$ and the second center axis $Ax_2$ extend along the tangential direction (circumferential direction) and the symmetry axis of the toroidal core 311, respectively. FIG. 3D illustrates the first magnetic flux 32 and the second magnetic flux 33 relative to the portion of the toroidal core 311. The first magnetic flux 32 flows in the toroidal core 311 along the circumferential direction and the second magnetic flux 33 flows upwards in an inner space of the second coil structure $W_{22}$. Accordingly, the first magnetic flux 32 within the toroidal core 311 is entirely orthogonal to the second magnetic flux 33 within the toroidal core 311. Therefore, orthogonal arrangement of the magnetic fields makes the signal interference between the first coil structure $W_{21}$ and the second coil structure $W_{22}$ minimized. For example, the magnetic coupling between the first coil structure $W_{21}$ and the second coil structure $W_{22}$ is less than 1%~20%. Hence, the two magnetic elements formed from the first coil structure $W_{21}$ and the second coil structure $W_{22}$ can function independently even though only one magnetic flux-guiding unit 31 is provided. Thus, compared with the conventional magnetic component including two magnetic flux-guiding units, the production cost, product size and number of units of the composite magnetic component according to the present disclosure are significantly reduced.

It is to be noted that the above-mentioned cross-sections do not exactly exist, but are used to explain the magnetic flux at a specific surface from a specific viewing angle. The toroidal core 311 and the coil structures $W_{21}$ and $W_{22}$ may be considered to be composed of infinite cross-sections.

In FIG. 3A and FIG. 3B, the first coil structure $W_{21}$ includes the first coil $W_{211}$ and the second coil $W_{212}$ which are radially wound around the toroidal body 3111 and have the first center axis $Ax_1$. In FIG. 3A and FIG. 3C, the second coil structure $W_{22}$ includes the third coil $W_{221}$ and the fourth coil $W_{222}$ which are circumferentially wound around the outer margin (outer circumference) 3112 and have the second center axis $Ax_2$. However, the present disclosure is not limited to the embodiment. For example, the third coil $W_{221}$ and the fourth coil $W_{222}$ of the second coil structure $W_{22}$ may be wound on an inner margin (inner circumference) of the toroidal core 311. Furthermore, the turns of the coils $W_{211}$, $W_{212}$, $W_{221}$ and $W_{222}$ can be varied or adjusted to meet practical requirements.

Figure 4:
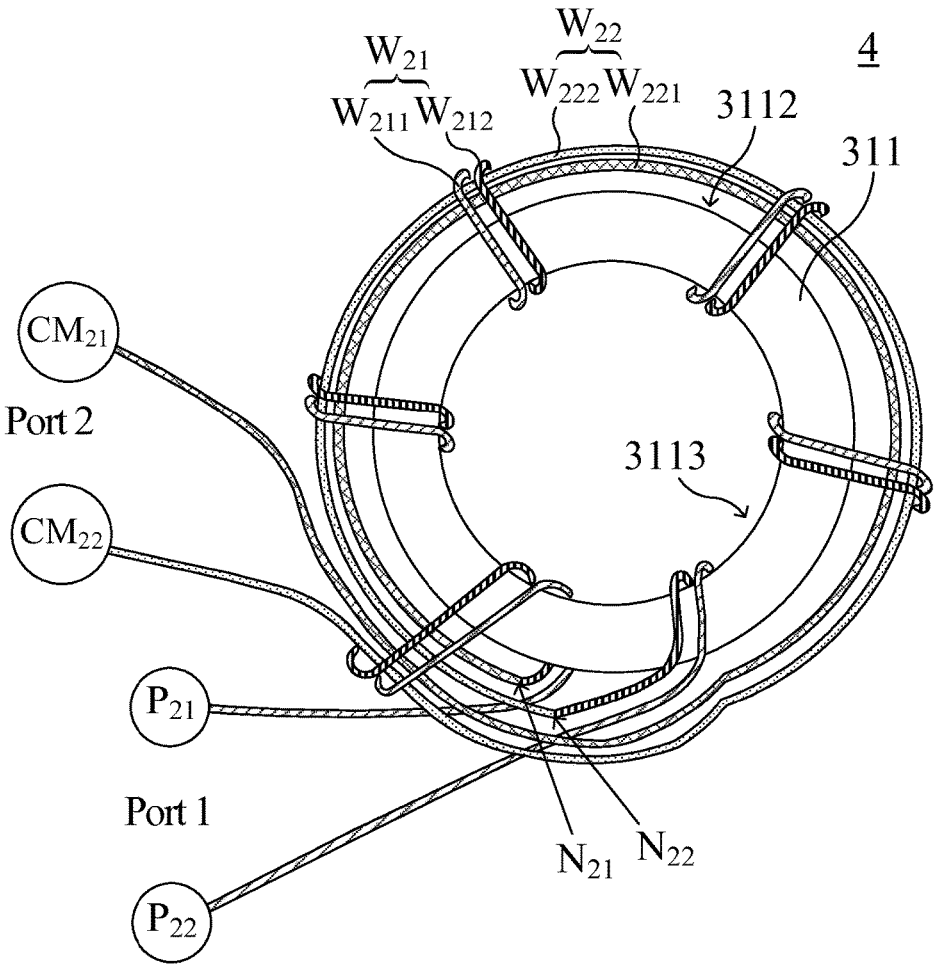
FIG. 4 is a schematic diagram illustrating another composite magnetic component meeting the equivalent circuit of FIG. 2.

FIG. 4 shows a variant of the composite magnetic component of FIG. 3A. In this embodiment, the composite magnetic component 4 meets the equivalent circuit of FIG. 2. The coils $W_{221}$~$W_{222}$ of the second coil structure $W_{22}$ are wound circumferentially around the outer margin (outer circumference) 3112 of the toroidal core 311. Then, the coils $W_{211}$~$W_{212}$ of the first coil structure $W_{21}$ are wound radially around the toroidal body 3111 together with the wound second coil structure $W_{22}$. In an alternative embodiment, the coils $W_{221}$~$W_{222}$ of the second coil structure $W_{22}$ are wound on the inner margin (inner circumference) 3113 of the toroidal core 311. Then, the coils $W_{211}$~$W_{212}$ of the first coil structure $W_{21}$ are radially wound around the toroidal body 3111 together with the wound second coil structure $W_{22}$. Other structure and magnetic property of the composite magnetic component 4 are similar to those of the composite magnetic component 3 as described with reference to FIGS. 3A-3D, and the detailed description is not given here again.

Figure 5A:
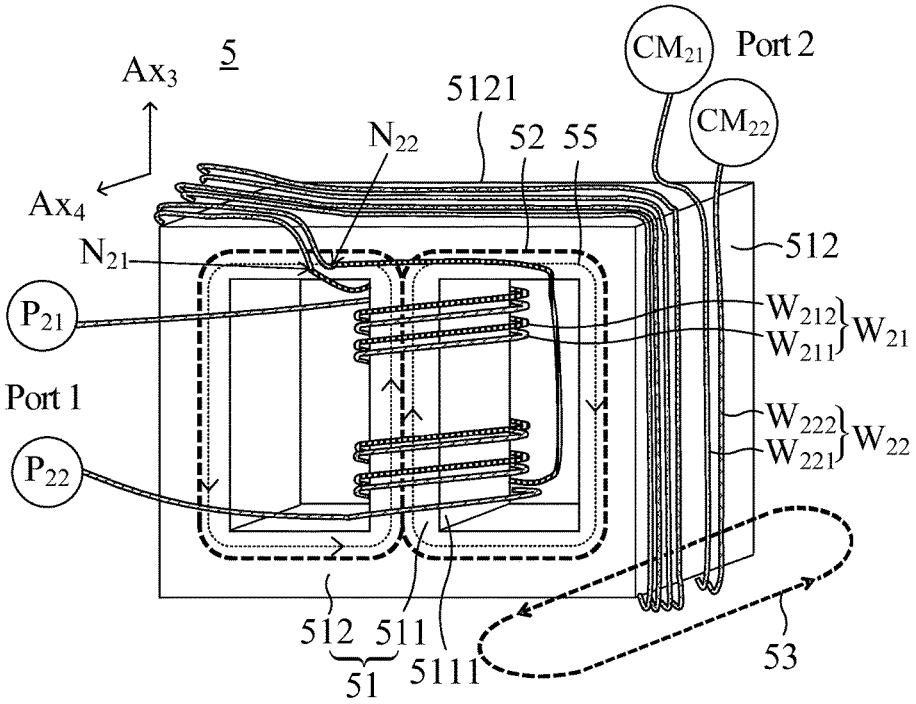
FIG. 5A is a perspective view illustrating a further composite magnetic component meeting the equivalent circuit of FIG. 2.
Figure 5B:
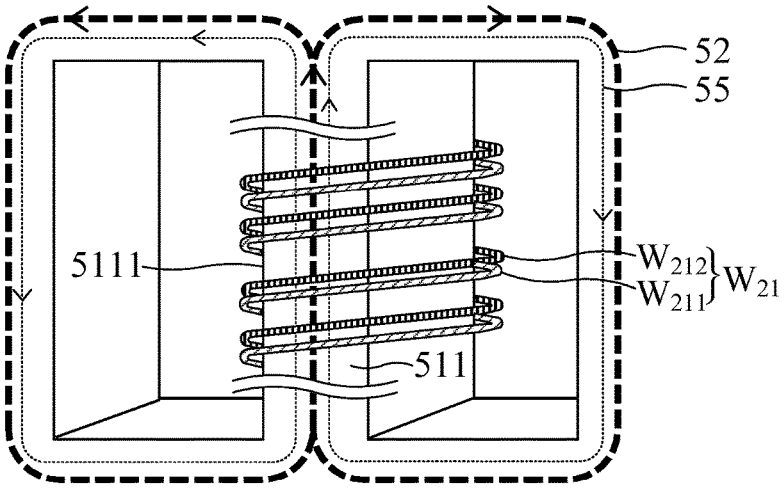
FIG. 5B is a schematic diagram illustrating the first magnetic flux generated by the composite magnetic component of FIG. 5A.
Figure 5C:
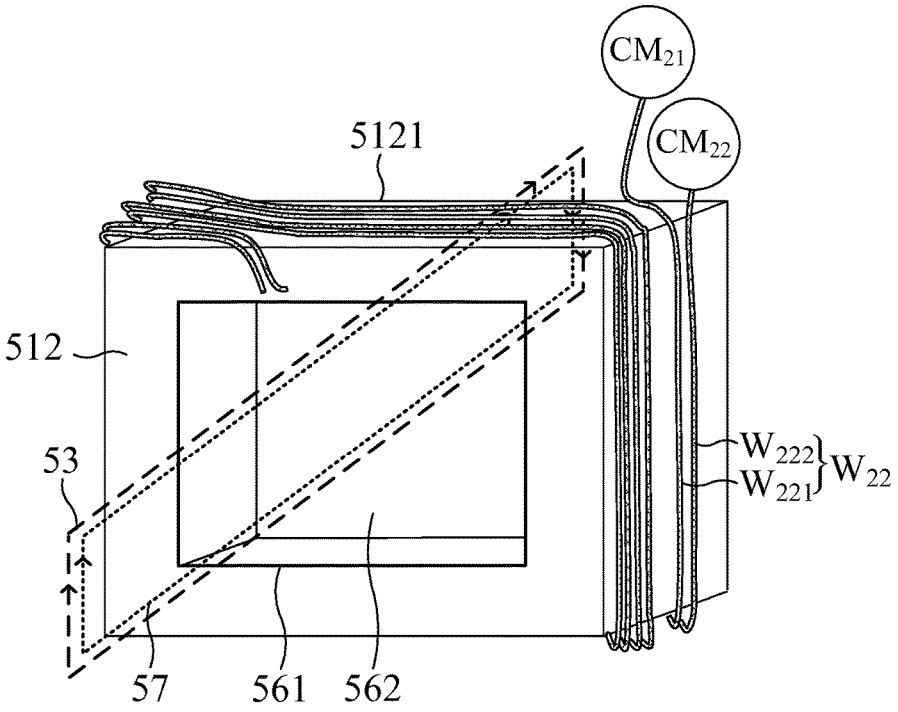
FIG. 5C is a schematic diagram illustrating the second magnetic flux generated by the composite magnetic component of FIG. 5A.

Please refer to FIG. 5A, FIG. 5B and FIG. 5C illustrating a further composite magnetic component meeting the equivalent circuit of FIG. 2. FIG. 5A shows the structure of the composite magnetic component. FIG. 5B shows the first magnetic flux resulting from the first coil structure and the magnetic flux-guiding unit. FIG. 5C shows the second magnetic flux resulting from the second coil structure and the magnetic flux-guiding unit. The magnetic flux-guiding unit 51 of the composite magnetic component 5 includes a center bridge 511 and a rectangular frame 512. Two ends of the center bridge 511 are connected to inner walls of the rectangular frame 512. The first winding portion 5111 includes lateral surfaces of the center bridge 511, and the second winding portion 5121 includes outer surfaces of the rectangular frame 512. The coils $W_{211}$~$W_{212}$ of the first coil structure $W_{21}$ are wound around the first winding portion 5111 and have a first center axis $Ax_3$, while the coils $W_{221}$~$W_{222}$ of the second coil structure $W_{22}$ are wound around the second winding portion 5121 and have a second center axis $Ax_4$. The first magnetic paths 55 are closed loops parallel to the magnetic flux-guiding unit 51 (FIG. 5B). The second magnetic paths 57 are closed loops perpendicular to the magnetic flux-guiding unit 51 (FIG. 5C). The first magnetic flux 52 flows along the center bridge 511, passes the connection between the center bridge 511 and the rectangular frame 512, flows along the rectangular frame 512, passes the other connection between the center bridge 511 and the rectangular frame 512, and flows back to the center bridge 511. The second magnetic flux 53 goes out the magnetic flux-guiding unit 51 through a front surface 561 of the magnetic flux-guiding unit 51, flows backwards outside the magnetic flux-guiding unit 51, reaches a back surface 562 of the magnetic flux-guiding unit 51, and enters the magnetic flux-guiding unit 51 through the back surface 562. As shown in FIG. 5A, the first magnetic flux 52 within the magnetic flux-guiding unit 51 is orthogonal to the second magnetic flux 53 within the magnetic flux-guiding unit 51.

Figure 6:
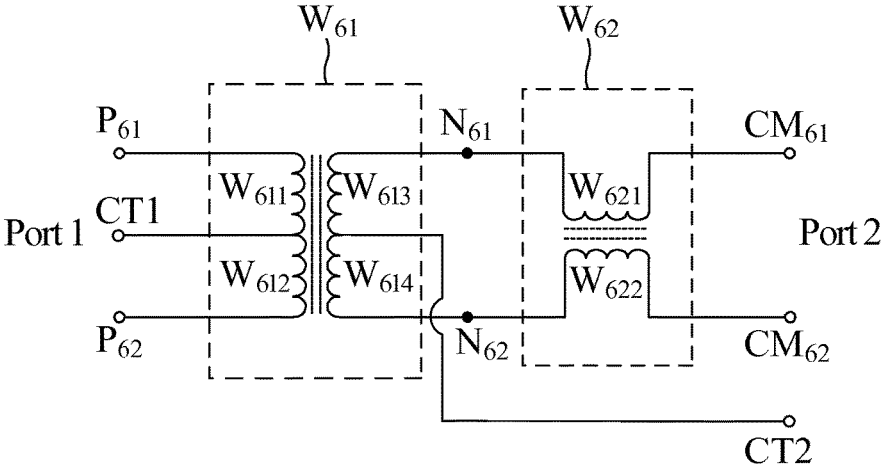
FIG. 6 is an equivalent circuit diagram of a composite magnetic component according to another embodiment of the present invention.

Please refer to FIG. 6, an equivalent circuit diagram of a composite magnetic component according to another embodiment of the present invention. The first coil structure $W_{61}$ includes a first coil $W_{611}$, a second coil $W_{612}$, a third coil $W_{613}$ and a fourth coil $W_{614}$, while the second coil structure $W_{62}$ includes a fifth coil $W_{621}$ and a sixth coil $W_{622}$. A first center tap CT1 and a second center tap CT2 are connected to the first coil structure $W_{61}$. One end of the first coil $W_{611}$ is electrically connected to a first terminal $P_{61}$ of a first port (Port 1), and the other end is electrically connected to the first center tap CT1. One end of the second coil $W_{612}$ is electrically connected to a second terminal $P_{62}$ of the first port (Port 1), and the other end is electrically connected to the first center tap CT1. One end of the third coil $W_{613}$ is electrically connected to a first node $N_{61}$, and the other end is electrically connected to the second center tap CT2. One end of the fourth coil $W_{614}$ is electrically connected to a second node $N_{62}$, and the other end is electrically connected to the second center tap CT2. One end of the fifth coil $W_{621}$ is electrically connected to the first node $N_{61}$, and the other end is electrically connected to a first terminal $CM_{61}$ of a second port (Port 2). One end of the sixth coil $W_{622}$ is electrically connected to the second node $N_{62}$, and the other end is electrically connected to a second terminal $CM_{62}$ of the second port (Port 2). For example, the first coil $W_{611}$ and the second coil $W_{612}$ are primary windings of a pulse transformer, while the third coil $W_{613}$ and the fourth coil $W_{614}$ are secondary windings of the pulse transformer.

In an embodiment, the first coil $W_{611}$ and the second coil $W_{612}$ have the same winding direction, while the third coil $W_{613}$ and the fourth coil $W_{614}$ have the same winding direction. The winding directions of the first coil $W_{611}$, the third coil $W_{613}$, the fifth coil $W_{621}$ and the sixth coil $W_{622}$ may be the same or different to meet various practical requirements.

Figure 7:
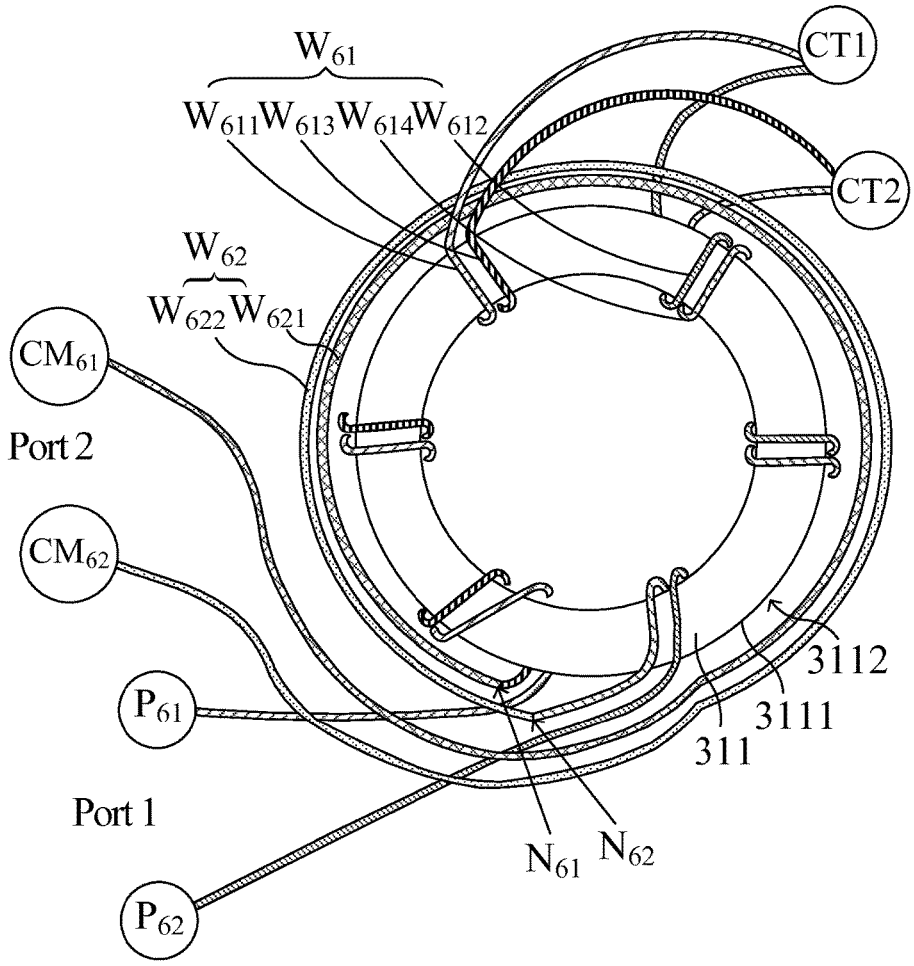
FIG. 7 is a schematic diagram illustrating a composite magnetic component meeting the equivalent circuit of FIG. 6.

Please refer to FIG. 7, a schematic diagram illustrating a composite magnetic component meeting the equivalent circuit of FIG. 6. The coils $W_{611}$~$W_{614}$ of the first coil structure $W_{61}$ are radially wound around the toroidal body 3111 of the toroidal core 311 and have the first center axis extending along the tangential direction (circumferential direction) of the toroidal core 311. The coils $W_{621}$~$W_{622}$ of the second coil structure $W_{62}$ are circumferentially wound around the outer margin (outer circumference) 3112 of the toroidal core 311 and have the second center axis in consistent with the symmetry axis of the toroidal core 311. In an alternative embodiment, the coils $W_{621}$~$W_{622}$ are wound on the inner margin (inner circumference) of the toroidal core 311. Other structure and magnetic property of the composite magnetic component are similar to those of the composite magnetic component 3 as described with reference to FIGS. 3A-3D, and the detailed description is not given here again.

Figure 8:
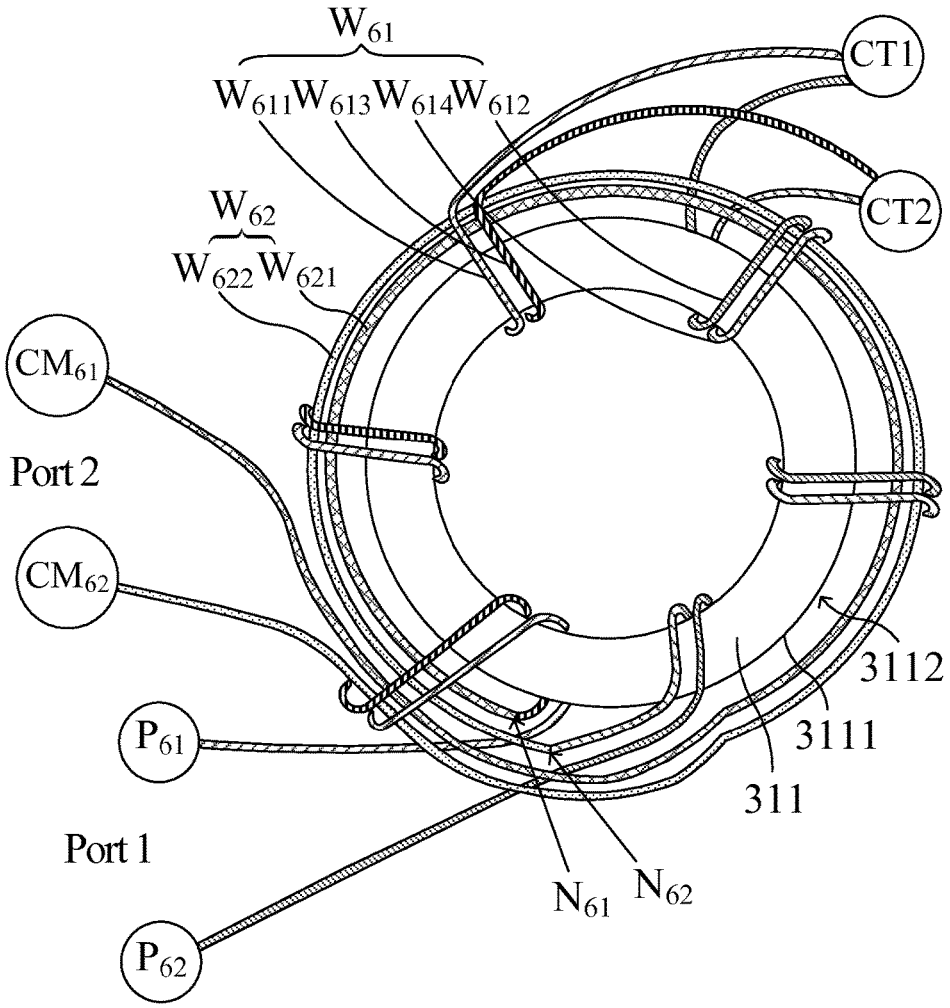
FIG. 8 is a schematic diagram illustrating another composite magnetic component meeting the equivalent circuit of FIG. 6.

Please refer to FIG. 8, a schematic diagram illustrating another composite magnetic component meeting the equivalent circuit of FIG. 6. The coils $W_{621}$~$W_{622}$ of the second coil structure $W_{62}$ are circumferentially wound around the outer margin (outer circumference) 3112 of the toroidal core 311 and have the second center axis extending along the symmetry axis of the toroidal core 311. In an alternative embodiment, the coils $W_{621}$~$W_{622}$ of the second coil structure $W_{62}$ are wound on the inner margin (inner circumference) of the toroidal core 311. Then, the coils $W_{611}$~$W_{614}$ of the first coil structure $W_{61}$ are radially wound around the toroidal body 3111 of the toroidal core 311 together with the wound second coil structure $W_{62}$. The coils $W_{611}$~$W_{614}$ of the first coil structure $W_{61}$ have the first center axis extending along the tangential direction (circumferential direction) of the toroidal core 311. Other structure and magnetic property of the composite magnetic component are similar to those of the composite magnetic component 3 as described with reference to FIGS. 3A-3D, and the detailed description is not given here again.

Figure 9:
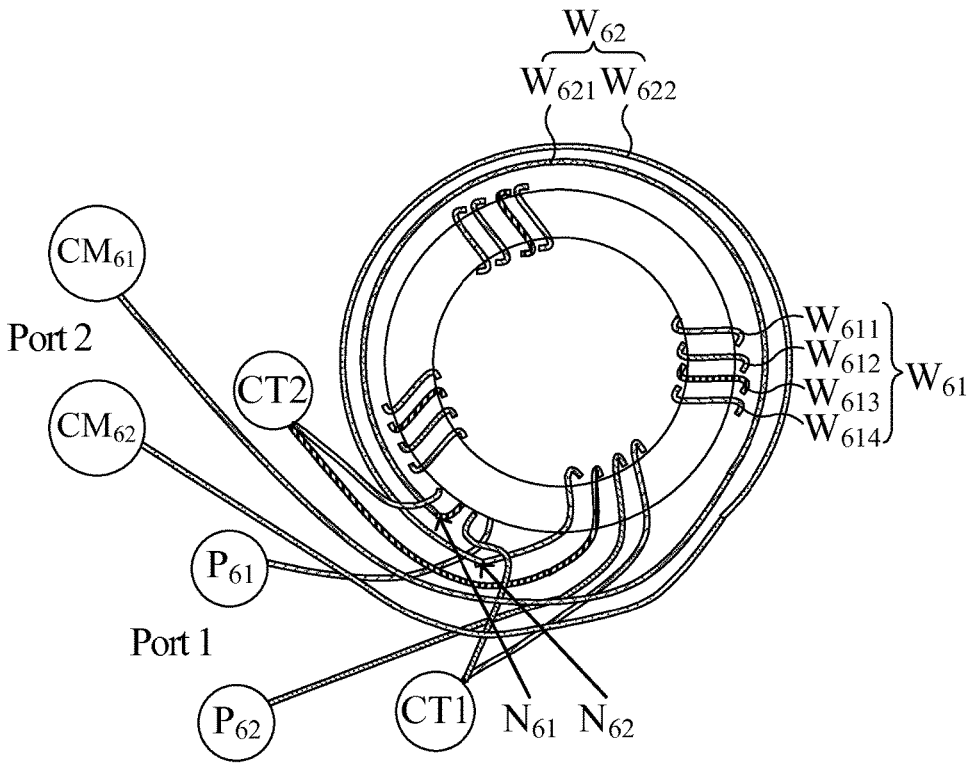
FIG. 9 is a schematic diagram illustrating a further composite magnetic component meeting the equivalent circuit of FIG. 6.

If the first coil structure and the second coil structure include a plurality of coils, the coils may be wound around the magnetic flux-guiding unit 31 sequentially in one-by-one manner. In another embodiment as shown in FIG. 9, the coils $W_{611}$~$W_{614}$ of the first coil structure $W_{61}$ are radially wound around the toroidal core 311 at the same time. Then, the cores $W_{621}$~$W_{622}$ of the second coil structure $W_{62}$ are circumferentially wound around the toroidal core 311 at the same time. Finally, electrical connections are made to connect ends of the coils $W_{611}$~$W_{614}$ and $W_{621}$~$W_{622}$ according to the equivalent circuit.

Figure 10A:
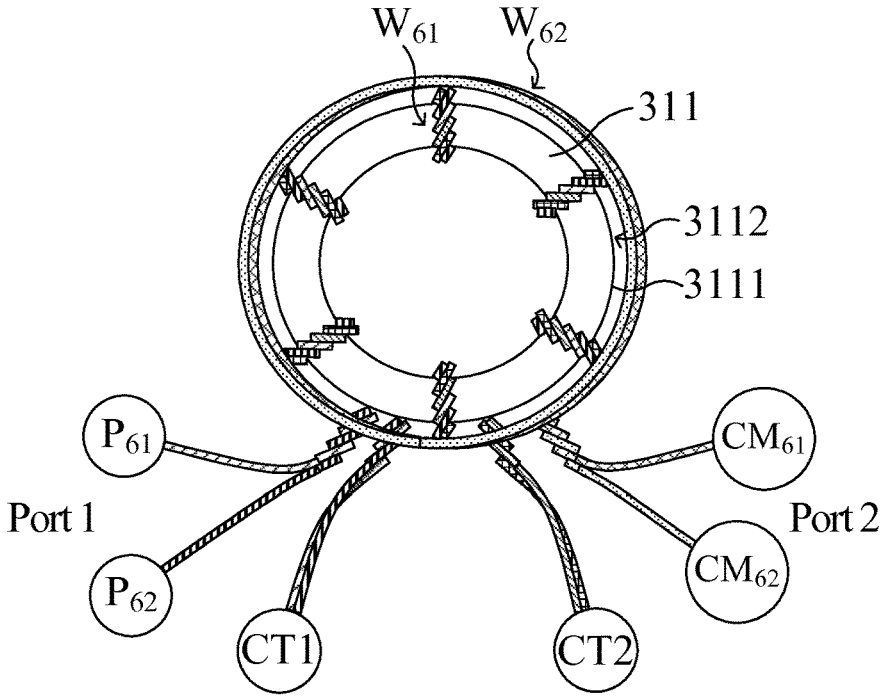
FIG. 10A is a schematic diagram illustrating a further composite magnetic component meeting the equivalent circuit of FIG. 6.
Figure 10B:
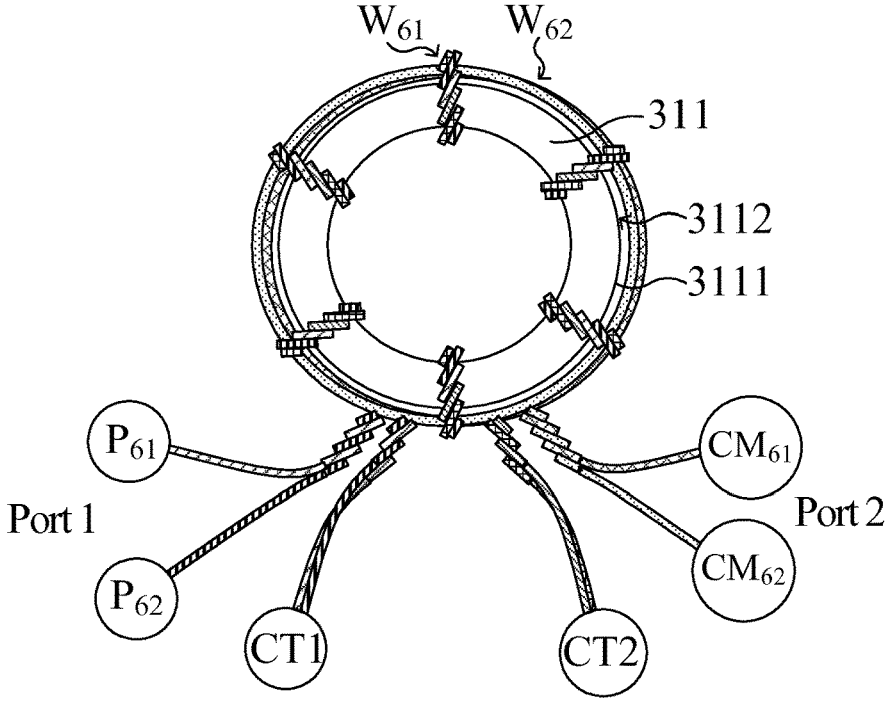
FIG. 10B is a schematic diagram illustrating a further composite magnetic component meeting the equivalent circuit of FIG. 6.

In a further embodiment, as shown in FIG. 10A, the coils of the first coil structure $W_{61}$ are twisted together, while the coils of the second coil structure $W_{62}$ are twisted together. Then, the twisted first coil structure $W_{61}$ is radially wound around the toroidal body 3111 of the toroidal core 311, and the twisted second coil structure $W_{62}$ is wound circumferentially around the outer margin (outer circumference) 3112 of the toroidal core 311. Finally, electrical connections are made to connect ends of the coils according to the equivalent circuit of FIG. 6. If the twisted second coil structure $W_{62}$ is wound around the toroidal core 311 before the twisted first coil structure $W_{61}$ is, the resulting structure is shown in FIG. 10B.

Figure 10C:
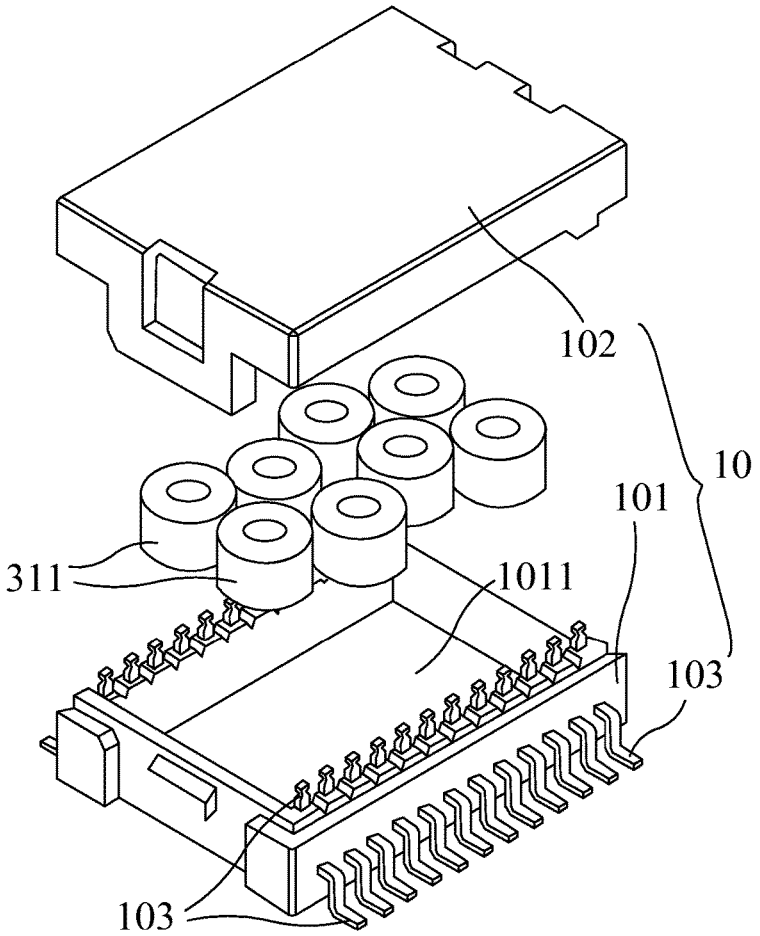
FIG. 10C is an exploded view illustrating a composite magnetic component package.
Figure 10D:
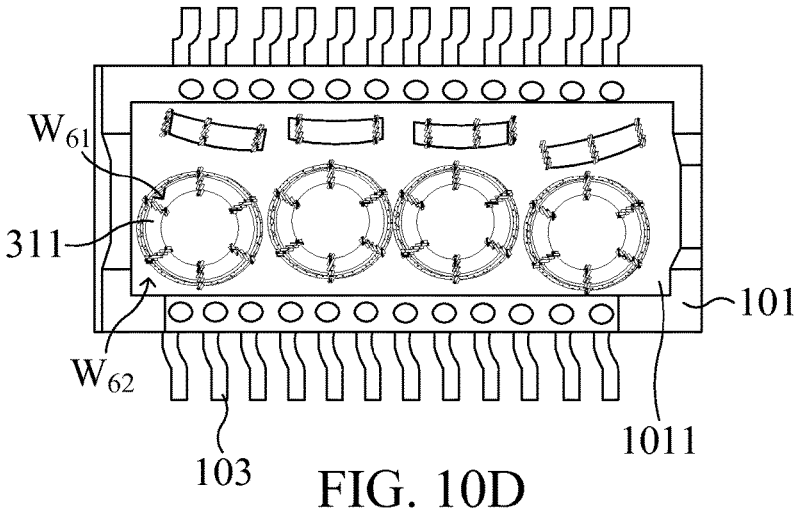
FIG. 10D is a top view illustrating assembly of a portion of the composite magnetic component package of FIG. 10C.

FIG. 10C is an exploded view illustrating a composite magnetic component package used for packaging the composite magnetic components in the above embodiments. The composite magnetic component package 10 includes a lower case 101, an upper case 102 and a plurality of electrode pins 103. A space 1011 for receiving the composite magnetic component (only the toroidal core 311 is shown) is defined in the lower case 101. After the toroidal cores 311 wound with the first coil structure $W_{61}$ and the second coil structure $W_{62}$ are placed in the space 1011 (FIG. 10D), one ends of the electrode pins 103 are electrically connected to the first terminal $P_{61}$ of the first port, the second terminal $P_{62}$ of the first port, the first center tap CT1, the second center tap CT2, the first terminal $CM_{61}$ of the second port or the second terminal $CM_{62}$ of the second port (not shown) of the composite magnetic component according to the desired electrical connections. Then, the upper case 102 is fixed to the lower case 101 to finish the assembly of the composite magnetic component package 10. At last, the other ends of the electrode pins 103 are electrically connected to a circuit board (not shown) so that the composite magnetic component of the present disclosure can function as two magnetic elements to cooperate with other circuits.

Figure 11A:
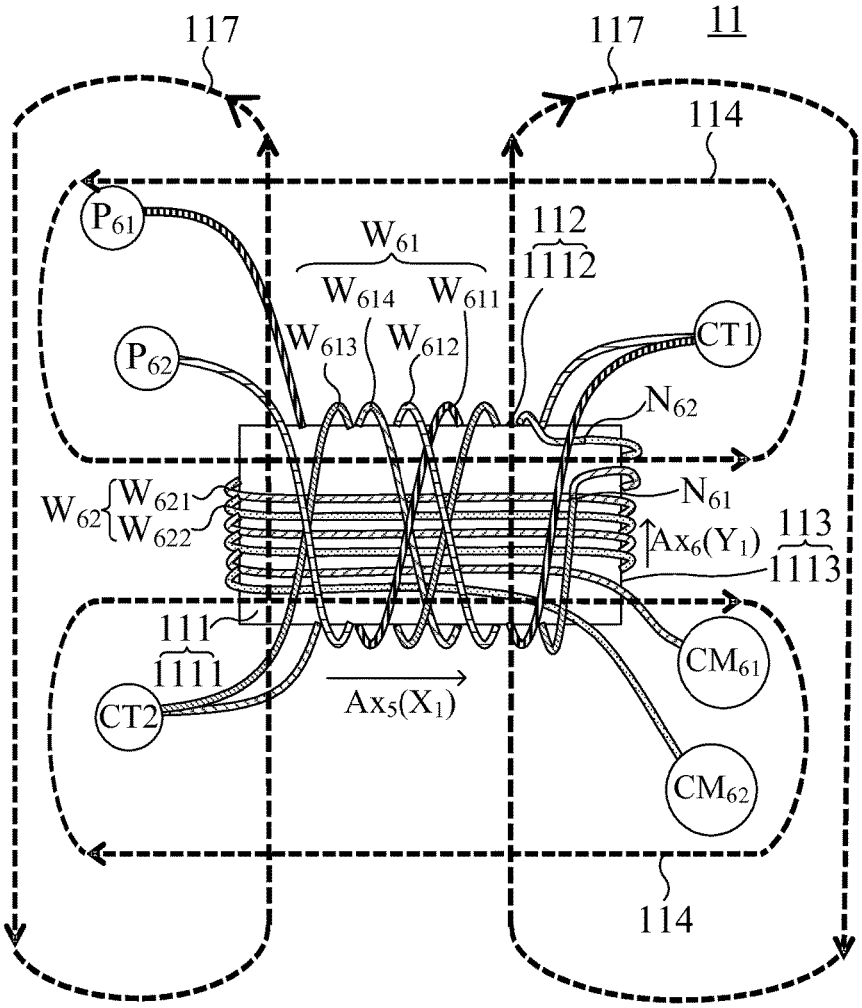
FIG. 11A is a schematic view illustrating a further composite magnetic component meeting the equivalent circuit of FIG. 6.

Please refer to FIG. 11A, a schematic view illustrating a further composite magnetic component meeting the equivalent circuit of FIG. 6. The composite magnetic component 11 includes a magnetic flux-guiding unit 111, a first coil structure $W_{61}$ and a second coil structure $W_{62}$. In this embodiment, the magnetic flux-guiding unit 111 is a cuboid-type core 1111. The first coil structure $W_{61}$ and the magnetic flux-guiding unit 111 form a first magnetic element, while the second coil structure $W_{62}$ and the magnetic flux-guiding unit 111 form a second magnetic element. The first magnetic element and the second magnetic element may be a pulse transformer and a common-mode filter, but the present disclosure is not limited thereto. In particular, the first coil structure $W_{61}$ includes a first coil $W_{611}$, a second coil $W_{612}$, a third coil $W_{613}$ and a fourth coil $W_{614}$, while the second coil structure $W_{62}$ includes a fifth coil $W_{621}$ and a sixth coil $W_{622}$. It is to be noted that a horizontal x-axis $X_1$ and a vertical y-axis $Y_1$ are defined in the embodiment for illustration only, and they are not used to limit the actual directions of the magnetic flux-guiding unit 111. The axes $X_1$ and $Y_1$ can be viewed as any orthogonal axes to achieve the present disclosure.

Figure 11B:
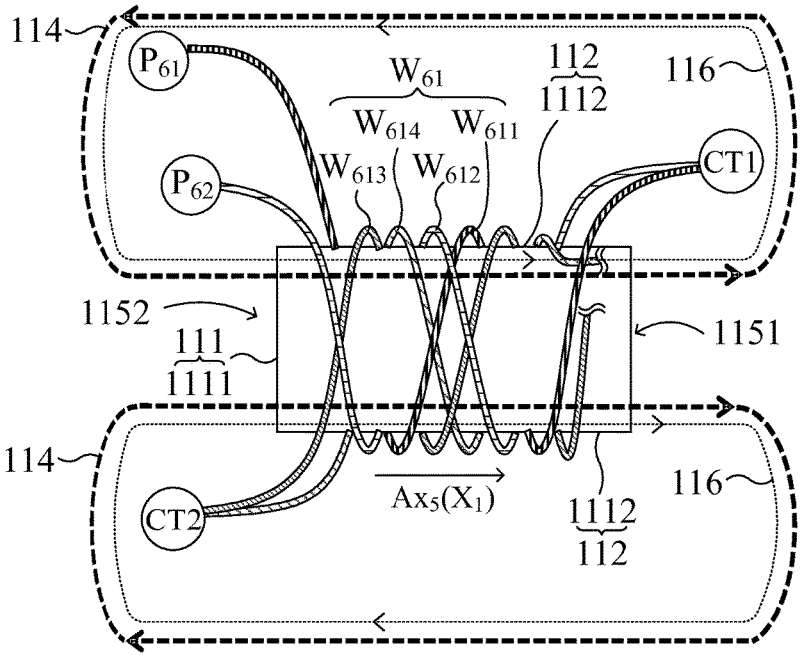
FIG. 11B is a schematic diagram illustrating the first magnetic flux generated by the composite magnetic component of FIG. 11A.

FIG. 11B shows the first magnetic flux 114 resulting from the first coil structure $W_{61}$ and the magnetic flux-guiding unit 111 of the composite magnetic component 11. The first coil structure $W_{61}$ (including the coils $W_{611}$~$W_{614}$) is wound around a first winding portion 112 (including four surfaces adjacent to long edges 1112) of the cuboid-type core 1111 and has a first center axis $Ax_5$ extending along the x-axis $X_1$. The first magnetic flux 114 passes through the right surface 1151 of the cuboid-type core 1111, flows leftwards outside the cuboid-type core 1111, reaches the left surface 1152 of the cuboid-type core 1111, and enters the cuboid-type core 1111 through the left surface 1152. The first magnetic paths 116 are closed loops, only sections of which are present within the cuboid-type core 1111.

Figure 11C:
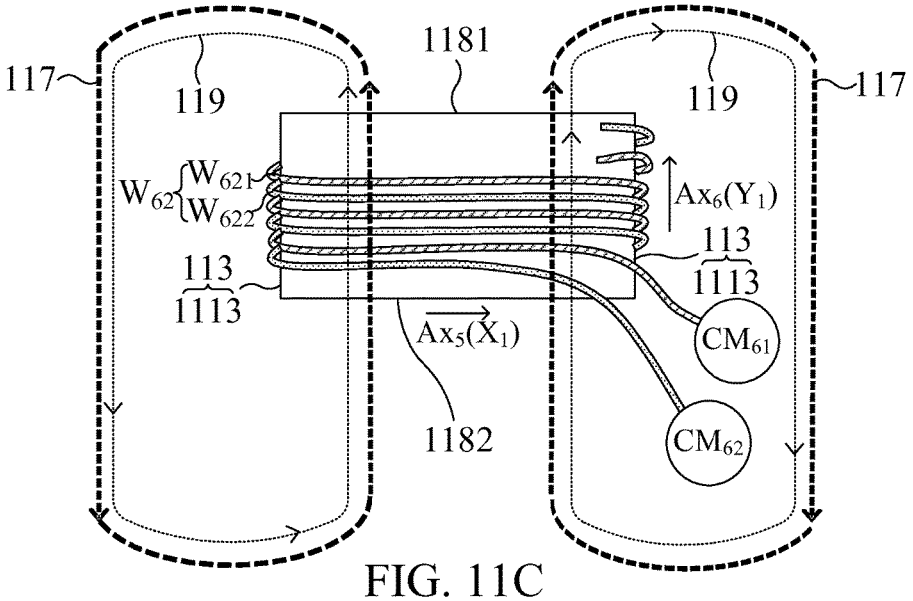
FIG. 11C is a schematic diagram illustrating the second magnetic flux generated by the composite magnetic component of FIG. 11A.

FIG. 11C shows the second first magnetic flux 117 resulting from the second coil structure $W_{62}$ and the magnetic flux-guiding unit 111 of the composite magnetic component 11. The second coil structure $W_{62}$ (including the coils $W_{621}$~$W_{622}$) is wound around a second winding portion 113 (including four surfaces adjacent to the short edges 1113) and has a second center axis $Ax_6$ extending along the y-axis $Y_1$. The second magnetic flux 117 passes through the top surface 1181 of the cuboid-type core 1111, flows downwards outside the cuboid-type core 1111, reaches the bottom surface 1182 of the cuboid-type core 1111 and enters the cuboid-type core 1111 through the bottom surface 1182. The second magnetic paths 119 are closed loops, only sections of which are present within the cuboid-type core 1111. The first magnetic flux 114 and the second magnetic flux 117 within the cuboid-type core 1111 are entirely orthogonal to each other.

Figure 12A:
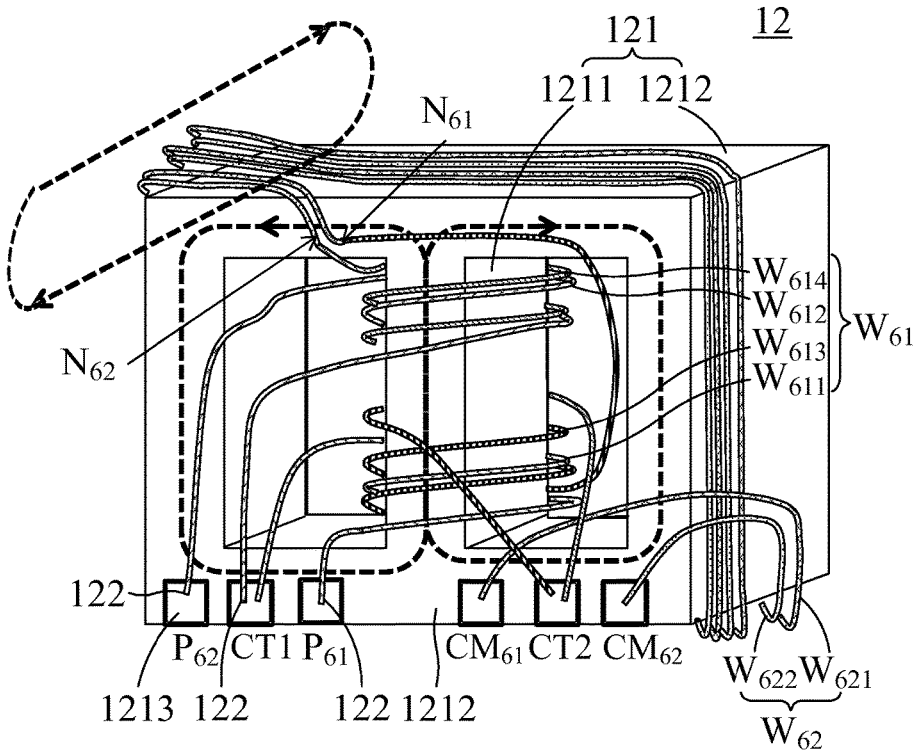
FIG. 12A is a perspective view illustrating a further composite magnetic component meeting the equivalent circuit of FIG. 6.

Please refer to FIG. 12A, a perspective view illustrating a further composite magnetic component meeting the equivalent circuit of FIG. 6. The magnetic flux-guiding unit 121 of the composite magnetic component 12 includes a center bridge 1211 and a rectangular frame 1212. A plurality of electrode units 1213 are deposited on the rectangular frame 1212. The electrode units 1213 function as the first terminal $P_{61}$ of the first port, the second terminal $P_{62}$ of the first port, the first center tap CT1, the second center tap CT2, the first terminal $CM_{61}$ of the second port or the second terminal $CM_{62}$ of the second port to be electrically connected to the coils $W_{611}$~$W_{614}$ of the first coil structure $W_{61}$ or the coils $W_{621}$~$W_{622}$ of the second coil structure $W_{62}$.

Figure 12B:
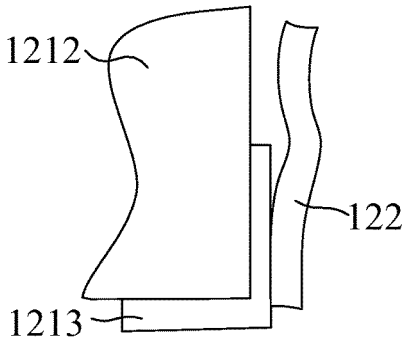
FIG. 12B is a schematic diagram illustrating the electrode unit of the composite magnetic component of FIG. 12 A.

The electrode units 1213 (L shape) are fixed to the rectangular frame 1212, and ends 122 of the coils $W_{611}$~$W_{614}$ and $W_{621}$~$W_{622}$ are electrically connected to the electrode units 1213 (FIG. 12B) according to the equivalent circuit of the composite magnetic component 12 by soldering, fusion welding, gluing, etc. Other structure and magnetic property of the composite magnetic component 12 are similar to those of the composite magnetic component 5 as described with reference to FIGS. 5A-5C, except the coil number of the first coil structure, and the detailed description is not given here again. The electrode structure described in the embodiment can be applied to other embodiments in the specification. For example, regarding the composite magnetic component with reference to FIG. 5A, the electrode units function as the first terminal $P_{21}$ of the first port, the second terminal $P_{22}$ of the first port, the first terminal $CM_{21}$ of the second port or the second terminal $CM_{22}$ of the second port to be electrically connected to the coils $W_{211}$~$W_{212}$ of the first coil structure $W_{21}$ or the coils $W_{221}$~$W_{222}$ of the second coil structure $W_{22}$.

Please refer back to FIG. 12A, the coils $W_{611}$~$W_{614}$ of the first coil structure $W_{61}$ and the coils $W_{621}$~$W_{622}$ of the second coil structure $W_{62}$ may be sequentially wound around the magnetic flux-guiding unit 121. For example, the coil winding procedure of the first coil $W_{611}$ includes: electrically connecting one end 122 of the first coil $W_{611}$ to the electrode unit 1213 representing the first terminal $P_{61}$ of the first port; winding the first coil $W_{611}$ around the center bridge 1211; and electrically connecting the other end 122 of the first coil $W_{611}$ to the electrode unit 1213 representing the first center tap CT1. The coil winding procedure of the second coil $W_{612}$ includes: electrically connecting one end 122 of the second coil $W_{612}$ to the electrode unit 1213 representing the first center tap CT1; winding the second coil $W_{612}$ around the center bridge 1211; and electrically connecting the other end 122 of the second coil $W_{612}$ to the electrode unit 1213 representing the second terminal $P_{62}$ of the first port. Similar coil winding procedures are performed for other coils of the first coil structure $W_{61}$ and the second coil structure $W_{62}$ in a specified sequence to finish winding the coils around the magnetic flux-guiding unit 121.

Figure 12C:
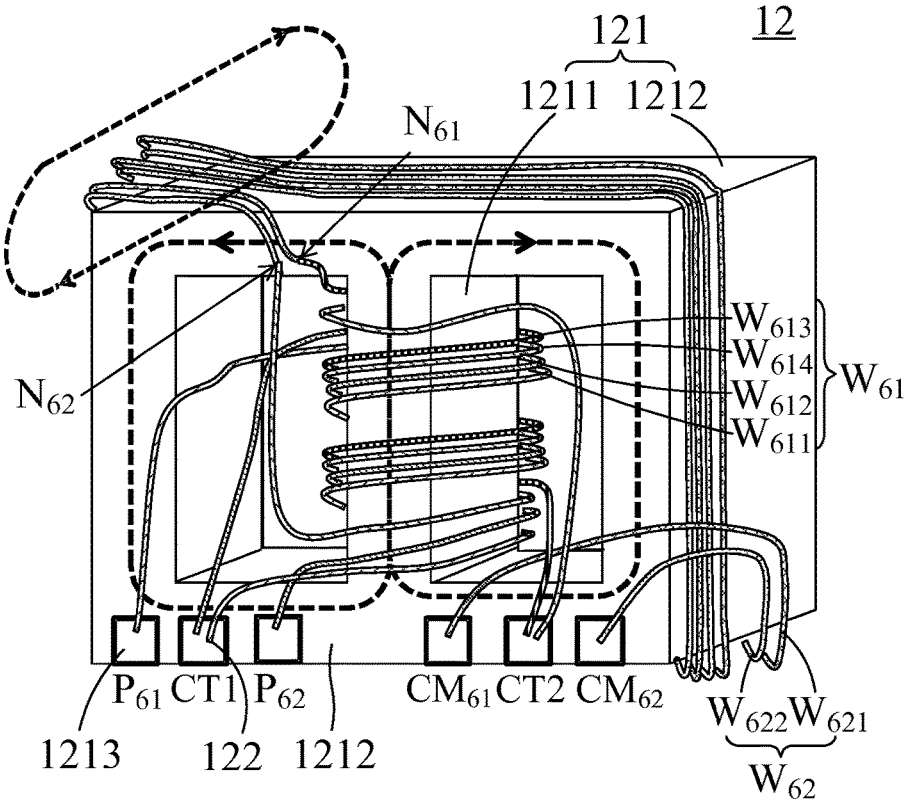
FIG. 12C is a perspective view illustrating a further composite magnetic component meeting the equivalent circuit of FIG. 6.

Another coil winding procedure for the first coil structure $W_{61}$ and the second coil structure $W_{62}$ are provided with reference to FIG. 12C. In this embodiment, the coil winding procedure includes: winding the coils $W_{611}$~$W_{614}$ of the first coil structure $W_{61}$ around the center bridge 1211 at the same time; winding the coils $W_{621}$~$W_{622}$ of the second coil structure $W_{62}$ around the rectangular frame 1212 at the same time; and electrically connecting two ends of the coils $W_{611}$~$W_{614}$ and $W_{621}$~$W_{622}$ to respective electrode units 1213. For example, one end 122 of the first coil $W_{611}$ is electrically connected to the electrode unit 1213 representing the first terminal $P_{61}$ of the first port and the other end 122 of the first coil $W_{611}$ is electrically connected to the electrode unit 1213 representing the first center tap CT1 so as to finish the coil procedure for the first coil $W_{611}$. Similarly, one end 122 of the second coil $W_{612}$ is electrically connected to the electrode unit 1213 representing the first center tap CT1 and the other end 122 of the second coil $W_{612}$ is electrically connected to the electrode unit 1213 representing the second terminal $P_{62}$ of the first port so as to finish the coil winding procedure for the second coil $W_{612}$. Similar connections are made to electrically connect two ends 122 of other coils of the first coil structure $W_{61}$ and the second coil structure $W_{62}$ to corresponding electrode units 1213 so as to finish winding the coils around the magnetic flux-guiding unit 121.

Figure 13A:
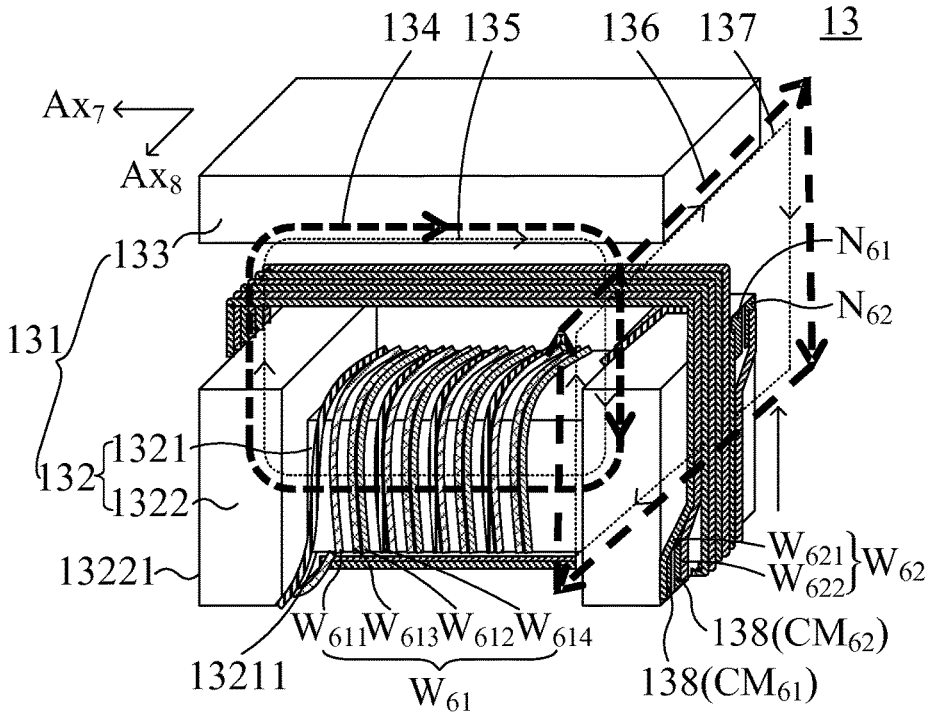
FIG. 13A is a perspective view illustrating a further composite magnetic component meeting the equivalent circuit of FIG. 6.

Please refer to FIG. 13A, a perspective view illustrating a further composite magnetic component meeting the equivalent circuit of FIG. 6. The composite magnetic component 13 includes a magnetic flux-guiding unit 131, a first coil structure $W_{61}$ and a second coil structure $W_{62}$. In this embodiment, the magnetic flux-guiding unit 131 includes an H shape core 132 and a plate 133. The H shape core 132 includes a bar 1321 and flanges 1322 at two ends of the bar 1321. The bar 1321 may be a round bar, a square bar or a polygonal bar. The first winding portion 13211 includes the bar 1321, while the second winding portion 13221 includes outer surfaces of the flanges 1322. Coils $W_{611}$~$W_{614}$ of the first coil structure $W_{61}$ are wound around the first winding portion 13211 and have a first center axis $Ax_7$ parallel to a lengthwise direction of the bar 1321. Coils $W_{621}$~$W_{622}$ of the second coil structure $W_{62}$ are wound onto the outer surfaces of the flanges 1322 and extend across a gap between the flanges 1322. The coils $W_{621}$~$W_{622}$ have a second center axis $Ax_8$ perpendicular to the first center axis $Ax_7$. The plate 133 is horizontally deposited above the bar 1321 and the coils $W_{621}$~$W_{622}$ of the second coil structure $W_{62}$. The first magnetic flux 134 flows along the lengthwise direction of the bar 1321, enters the left flange 1322, turns towards the plate 133, flows rightwards along a lengthwise direction of the plate 133, turns towards the right flange 1322 and flows back to the bar 1321. The first magnetic paths 135 are closed loops parallel to the lengthwise direction of the H shape core 132 (i.e. the first center axis $Ax_7$). The second magnetic flux 136 penetrates the H shape core 132 along a widthwise direction of the H shape core 132, turns towards the plate 133, penetrates the plate 133 along a widthwise direction of the plate 133 and flows back to the H shape core 132. The second magnetic paths 137 are closed loops parallel to the widthwise direction of the H shape core 132 (i.e. the second center axis $Ax_8$). In other words, the second magnetic flux 136 passes through the H shape core 132 and the plate 133 perpendicularly. The first magnetic flux 134 within the magnetic flux-guiding unit 131 is orthogonal to the second magnetic flux 136 within the magnetic flux-guiding unit 131.

Figure 13B:
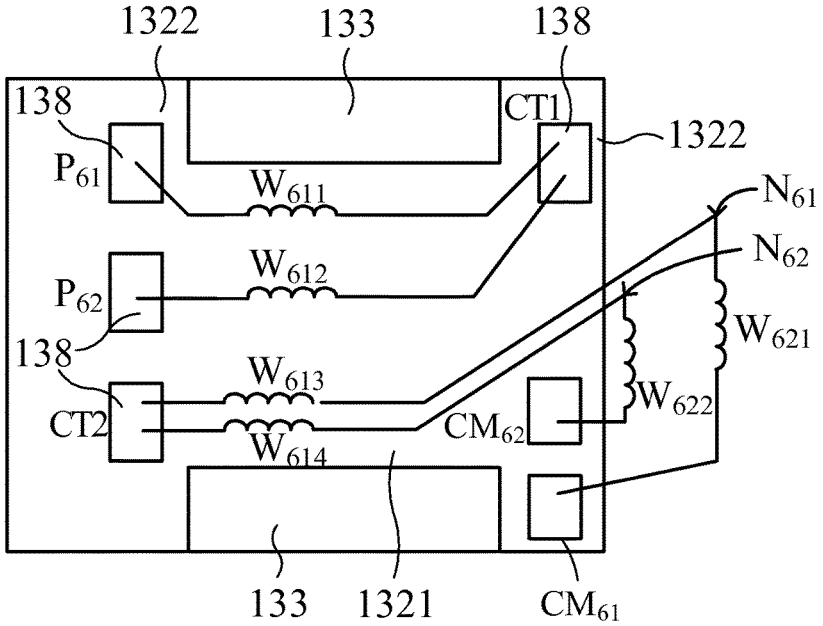
FIG. 13B is a schematic diagram illustrating electrical connections between the coils of the composite magnetic component of FIG. 13A.

Electrical connections between the coils $W_{611}$~$W_{614}$ and $W_{621}$~$W_{622}$ of the first coil structure $W_{61}$ and the second coil structure $W_{62}$ are shown in FIG. 13B. In this embodiment, a plurality of electrode units 138 are deposited on the outer surface of the flange 1322 of the H shape core 132 of the magnetic flux-guiding unit 131. The electrode units 138 function as the first terminal $P_{61}$ of the first port, the second terminal $P_{62}$ of the first port, the first center tap CT1, the second center tap CT2, the first terminal $CM_{61}$ of the second port or the second terminal $CM_{62}$ of the second port to be electrically connected to the coils $W_{611}$~$W_{614}$ of the first coil structure $W_{61}$ or the coils $W_{621}$~$W_{622}$ of the second coil structure $W_{62}$.

According to the equivalent circuit of FIG. 6, two ends of the first coil $W_{611}$ are electrically connected to two electrode units 138 representing the first terminal $P_{61}$ of the first port and the first center tap CT1, respectively. Two ends of the second coil $W_{612}$ are electrically connected to two electrode units 138 representing the second terminal $P_{62}$ of the first port and the first center tap CT1, respectively. One end of the third coil $W_{613}$ is electrically connected to the electrode unit 138 representing the second center tap CT2, and the other end of the third coil $W_{613}$ is electrically connected to the first node $N_{61}$. One end of the fourth coil $W_{614}$ is electrically connected to the electrode unit 138 representing the second center tap CT2, and the other end of the fourth coil $W_{614}$ is electrically connected to the second node $N_{62}$. One end of the fifth coil $W_{621}$ is electrically connected to the first node $N_{61}$, and the other end of the fifth coil $W_{621}$ is electrically connected to the electrode unit 138 representing the first terminal $CM_{61}$ of the second port. One end of the sixth coil $W_{622}$ is electrically connected to the second node $N_{62}$, and the other end of the sixth coil $W_{622}$ is electrically connected to the electrode unit 138 representing the second terminal $CM_{62}$ of the second port.

Figure 14:
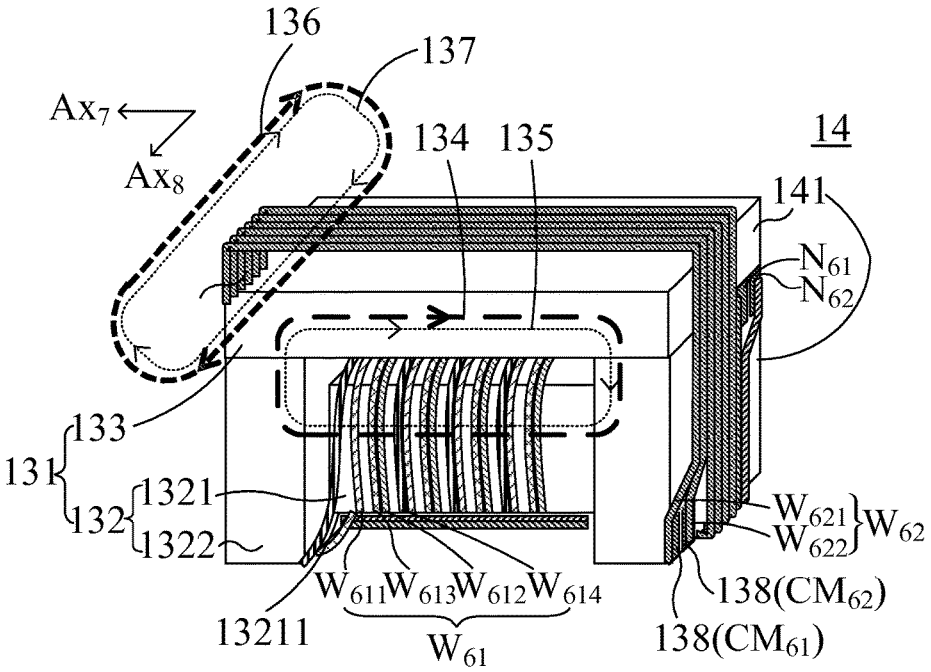
FIG. 14 is a perspective view illustrating a further composite magnetic component meeting the equivalent circuit of FIG. 6.

Please refer to FIG. 14, a perspective view illustrating a further composite magnetic component meeting the equivalent circuit of FIG. 6. The composite magnetic component 14 has a similar structure to the embodiment with reference to FIG. 13A, but the plate 133 is placed on the flanges 1322. The first winding portion 13211 includes the bar 1321 of the H shape core 132 of the magnetic flux-guiding unit 131. The second winding portion 141 includes the outer surfaces of the flanges 1322 and the plate 133. The coils $W_{611}$~$W_{614}$ of the first coil structure $W_{61}$ are wound around the first winding portion 13211 and have the first center axis $Ax_7$ parallel to the lengthwise direction of the bar 1321. After the plate 133 is fitted to the H shape core 132, the coils $W_{621}$~$W_{622}$ of the second coil structure $W_{62}$ are wound around the second winding portion 141, i.e. outer surfaces of the flanges 1322 and the plate 133. The coils $W_{621}$~$W_{622}$ have the second center axis $Ax_8$ perpendicular to the first center axis $Ax_7$. The first magnetic flux 134 flows along the lengthwise direction of the bar 1321, enters the left flange 1322, turns towards the plate 133, flows rightwards along the lengthwise direction of the plate 133, turns towards the right flange 1322 and flows back to the bar 1321. The first magnetic paths 135 are closed loops parallel to the lengthwise direction of the H shape core 132 (i.e. the first center axis $Ax_7$). The second magnetic flux 136 penetrates the H shape core 132 and the plate 133 along the widthwise direction of the H shape core 132, flows outside the magnetic flux-guiding unit 131 in an opposite direction, and flows back to the H shape core 132 and the plate 133. The second magnetic paths 137 are closed loops parallel to the widthwise direction of the H shape core 132 (i.e. the second center axis $Ax_8$). In other words, the second magnetic flux 136 passes through the H shape core 132 and the plate 133 perpendicularly. The first magnetic flux 134 within the magnetic flux-guiding unit 131 is orthogonal to the second magnetic flux 136 within the magnetic flux-guiding unit 131. The electrical connections between the coils $W_{611}$~$W_{614}$ and $W_{621}$~$W_{622}$ of the first coil structure $W_{61}$ and the second coil structure $W_{62}$ and the magnetic property of the composite magnetic component 14 are similar to those of the composite magnetic component 13 as described with reference to FIG. 13A and FIG. 13B, and the detailed description is not given here again.

Figure 15A:
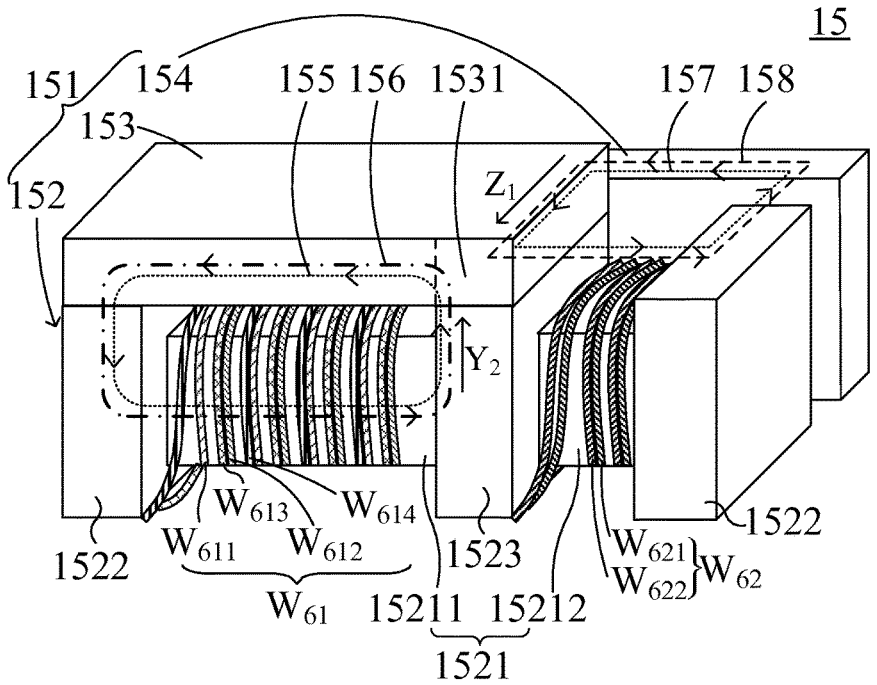
FIG. 15A is a perspective view illustrating a further composite magnetic component meeting the equivalent circuit of FIG. 6.

Please refer to FIG. 15A, a perspective view illustrating a further composite magnetic component meeting the equivalent circuit of FIG. 6. In this embodiment, the composite magnetic component 15 includes a magnetic flux-guiding unit 151, a first coil structure $W_{61}$ and a second coil structure $W_{62}$. The magnetic flux-guiding unit 151 includes a modified H shape core 152 (H-H shape core), a first plate 153 and a second plate 154. The modified H shape core 152 includes a bar 1521 and two flanges 1522 at two ends of the bar 1521. In addition, a protruding part 1523 is formed around the bar 1521 between the two flanges 1522. The protruding part 1523 separates the bar 1521 to form a first winding portion 15211 and a second winding portion 15212. Coils $W_{611}$~$W_{614}$ of the first coil structure $W_{61}$ are wound around the first winding portion 15211, while coils $W_{621}$~$W_{622}$ of the second coil structure $W_{62}$ are wound around the second winding portion 15212. The first plate 153 is horizontally placed above the first winding portion 15211 between the left flange 1522 and the protruding part 1523. The second plate 154 is vertically placed at a rear side of the second winding portion 15212 between the protruding part 1523 and the right flange 1522. The second plate 154 may be in contact with the protruding part 1523 and the right flange 1522 or connected to the protruding part 1523 and the right flange 1522 through a binder (not shown). The first magnetic paths 155 are closed loops covering the left portion of the bar 1521, the protruding part 1523, the first plate 153 and the left flange 1522. The second magnetic paths 157 are closed loops covering the right portion of the bar 1521, the right flange 1522, the second plate 154 and the protruding part 1523. The first magnetic flux 156 flows along the first magnetic paths 155, while the second magnetic flux 158 flows along the second magnetic paths 157. The first magnetic flux 156 and the second magnetic flux 158 orthogonally intersect at flux intersections within the protruding part 1523 of the magnetic flux-guiding unit 151. In particular, at all flux intersections within the protruding part 1523, the first magnetic flux 156 is orthogonal to the second magnetic flux 158. As shown in FIG. 15A, the first magnetic flux 156 flows along the direction $Y_2$ and the second magnetic flux 158 flows along the direction $Z_1$ within the protruding part 1523. Therefore, the signal interference between the first coil structure $W_{61}$ and the second coil structure $W_{62}$ is minimized. Hence, the two magnetic elements formed from the first coil structure $W_{61}$ and the second coil structure $W_{62}$ can function independently even though only one magnetic flux-guiding unit 151 is provided. Thus, compared with the conventional magnetic component including two magnetic flux-guiding units, the production cost, product size and number of units of the composite magnetic component according to the present disclosure are reduced.

If the second plate 154 is high enough to reach the first plate 153, the second magnetic paths 157 are closed loops covering the right portion of the bar 1521, the right flange 1522, the second plate 154, the protruding part 1523 and a portion 1531 of the first plate 153 on the protruding part 1523. Under this condition, the first magnetic flux 156 and the second magnetic flux 158 intersect at flux intersections within the protruding part 1523 and the portion 1531 of the first plate 153. At nearly all the flux intersections within the protruding part 1523 and the portion 1531 of the first plate 153, the first magnetic flux 156 is orthogonal to the second magnetic flux 158 (e.g. greater than 80%~99%). Only minor portions of the first magnetic flux 156 and the second magnetic flux 158 are not orthogonal to each other at the flux intersections within the portion 1531 of the first plate 153. For example, considering all of the flux intersections within the magnetic flux-guiding unit 151, less than 1%~20% of the first magnetic flux 156 at the flux intersections is not orthogonal to the second magnetic flux 158, and vice versa. The resultant magnetic coupling is less than 1%~20% so that the two magnetic elements are still substantially electrically independent.

Figure 15B:
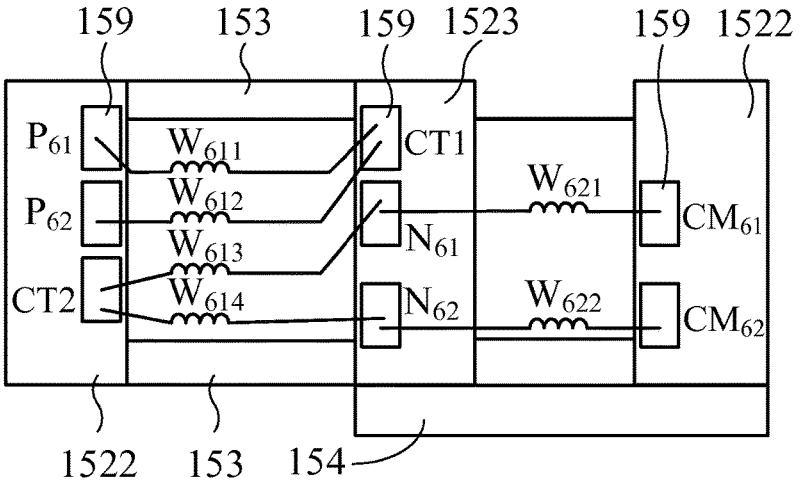
FIG. 15B is a schematic diagram illustrating electrical connections between the coils of the composite magnetic component of FIG. 15A.

Electrical connections between the coils $W_{611}$~$W_{614}$ and $W_{621}$~$W_{622}$ of the first coil structure $W_{61}$ and the second coil structure $W_{62}$ are shown in FIG. 15B. In this embodiment, a plurality of electrode units 159 are deposited on top surfaces or bottom surfaces of the flanges 1522 and the protruding part 1523 of the modified H shape core 152 (H-H shape core) of the magnetic flux-guiding unit 151. The electrode units 159 function as the first terminal $P_{61}$ of the first port, the second terminal $P_{62}$ of the first port, the first center tap CT1, the second center tap CT2, the first terminal $CM_{61}$ of the second port, the second terminal $CM_{62}$ of the second port, the node $N_{61}$ or the node $N_{62}$ to be electrically connected to the coils $W_{611}$~$W_{614}$ of the first coil structure $W_{61}$ or the coils $W_{621}$~$W_{622}$ of the second coil structure $W_{62}$.

According to the equivalent circuit of FIG. 6, two ends of the first coil $W_{611}$ are electrically connected to two electrode units 159 representing the first terminal $P_{61}$ of the first port and the first center tap CT1, respectively. Two ends of the second coil $W_{612}$ are electrically connected to two electrode units 159 representing the second terminal $P_{62}$ of the first port and the first center tap CT1, respectively. Two ends of the third coil $W_{613}$ are electrically connected to the electrode units 159 representing the second center tap CT2 and the first node $N_{61}$, respectively. Two ends of the fourth coil $W_{614}$ are electrically connected to the electrode units 159 representing the second center tap CT2 and the second node $N_{62}$, respectively. Two ends of the fifth coil $W_{621}$ are electrically connected to the electrode units 159 representing the first node $N_{61}$ and the first terminal $CM_{61}$ of the second port, respectively. Two ends of the sixth coil $W_{622}$ are electrically connected to the electrode units 159 representing the second node $N_{62}$ and the second terminal $CM_{62}$ of the second port, respectively.

Figure 16A:
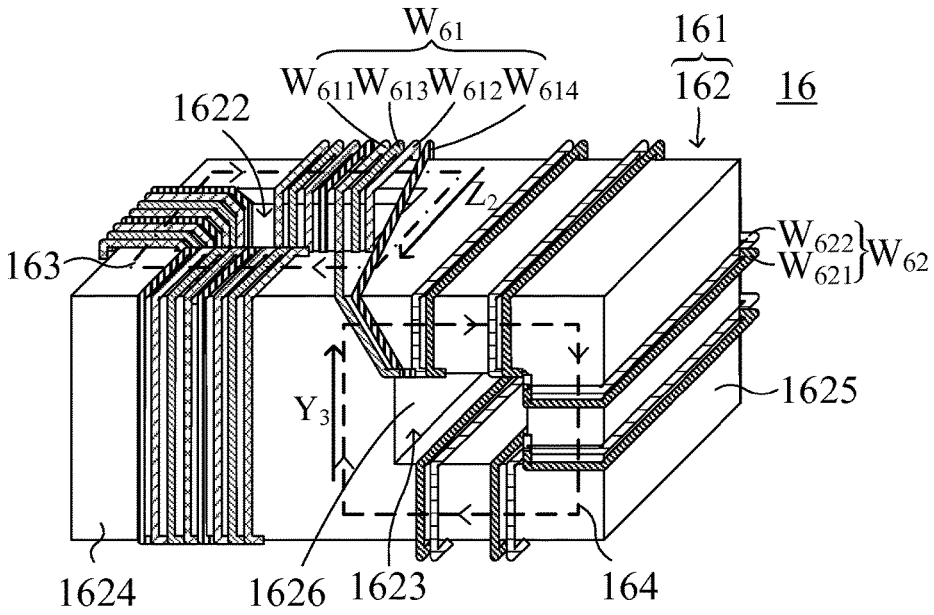
FIG. 16A is a perspective view illustrating a further composite magnetic component meeting the equivalent circuit of FIG. 6.

Please refer to FIG. 16A, a perspective view illustrating a further composite magnetic component meeting the equivalent circuit of FIG. 6. The composite magnetic component 16 includes a magnetic flux-guiding unit 161, a first coil structure $W_{61}$ and a second coil structure $W_{62}$. In this embodiment, the magnetic flux-guiding unit 161 includes a cuboid-type core 162 having a first through hole 1622 and a second through hole 1623. The first through hole 1622 and the second through hole 1623 are perpendicular to each other. The first through hole 1622 is not connected to the second through hole 1623. For example, the first through hole 1622 at the left portion of the cuboid-type core 162 connects a top surface and a bottom surface of the cuboid-type core 162, while the second through hole 1623 at the right portion of the cuboid-type core 162 connects a front surface and a rear surface of the cuboid-type core 162. The first through hole 1622 is surrounded by walls 1624 (U shape) and a center wall 1626, and the second through hole 1623 is surrounded by walls 1625 (U shape) and the center wall 1626. Coils $W_{611}$~$W_{614}$ of the first coil structure $W_{61}$ are wound vertically around the walls 1624 (e.g. the front wall, the left wall and the rear wall) of the first through hole 1622, and coils $W_{621}$~$W_{622}$ of the second coil structure $W_{62}$ are horizontally wound around the walls 1625 (e.g. the top wall, the right wall and the bottom wall) of the second through hole 1623. The first magnetic flux 163 in the cuboid-type core 162 flows around the first through hole 1622, while the second magnetic flux 164 in the cuboid-type core 162 flows around the second through hole 1623. In particular, in the center wall 1626 between the first though hole 1622 and the second hole 1623, the first magnetic flux 163 flows along a direction $Z_2$ in parallel with a direction of the second through hole 1623, and the second magnetic flux 164 flows along a direction $Y_3$ in parallel with a direction of the first through hole 1622. The first magnetic flux 163 and the second magnetic flux 164 orthogonally intersect within the center wall 1626 of the magnetic flux-guiding unit 161. In other words, at all flux intersections of the first magnetic flux 163 and the second magnetic flux 164 within the center wall 1626, the first magnetic flux 163 is orthogonal to the second magnetic flux 164. Therefore, the signal interference between the first coil structure $W_{61}$ and the second coil structure $W_{62}$ is minimized. Hence, the two magnetic elements formed from the first coil structure $W_{61}$ and the second coil structure $W_{62}$ can function independently even though only one magnetic flux-guiding unit 161 is provided. Thus, compared with the conventional magnetic component including two magnetic flux-guiding units, the production cost, product size and number of units of the composite magnetic component according to the present disclosure are reduced.

A plurality of electrode units (not shown) are provided for the magnetic flux-guiding unit 161 to provide proper electrical connections between the coils $W_{611}$~$W_{614}$ and $W_{621}$~$W_{622}$ of the first coil structure $W_{61}$ and the second coil structure $W_{62}$. The electrical connections may be made according to the equivalent circuit of FIG. 6 and are not given here again.

Figure 16B:
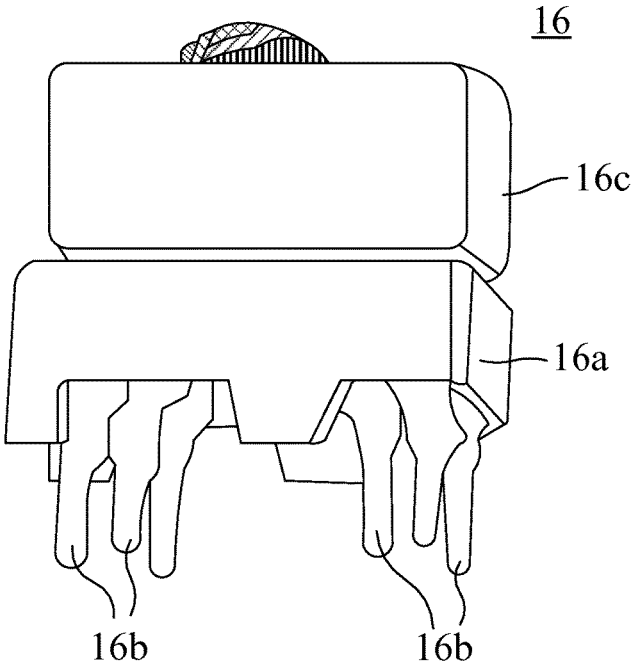
FIG. 16B is a perspective view illustrating a further composite magnetic component.

A connection module having a plurality of pins is provided to connect the composite magnetic component to other circuits. As shown in FIG. 16B, the composite magnetic component 16 further includes a connection module 16*a*, and the magnetic flux-guiding unit 16*c* is disposed on the connection module 16*a*. Each of the pins 16*b* is electrically connected to a corresponding electrode unit representing the first terminal $P_{61}$ of the first port, the second terminal $P_{62}$ of the first port, the first center tap CT1, the second center tap CT2, the first terminal $CM_{61}$ of the second port, the second terminal $CM_{62}$ of the second port, the node $N_{61}$ or the node $N_{62}$. Therefore, the composite magnetic component 16*c* can be electrically connected to a circuit board by inserting the pins 16*b* of the connection module 16*a* into a corresponding socket of the circuit board.

Figure 17:
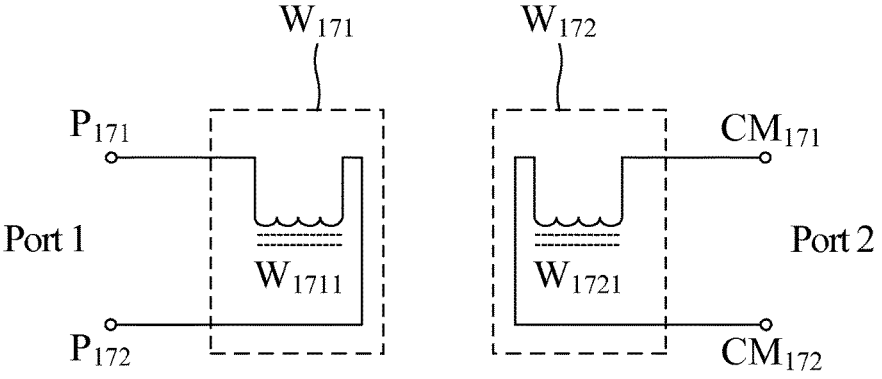
FIG. 17 is an equivalent circuit diagram of a composite magnetic component according to a further embodiment of the present invention.

Please refer to FIG. 17, an equivalent circuit diagram of a composite magnetic component according to a further embodiment of the present invention. The first coil structure $W_{171}$ includes a first coil $W_{1711}$, and the second coil structure $W_{172}$ includes a second coil $W_{1721}$. Two ends of the first coil $W_{1711}$ are respectively connected to a first terminal $P_{171}$ and a second terminal $P_{172}$ of a first port (Port 1); and two ends of the second coil $W_{1721}$ are respectively connected to a first terminal $CM_{171}$ and a second terminal $CM_{172}$ of a second port (Port 2).

Figure 18A:
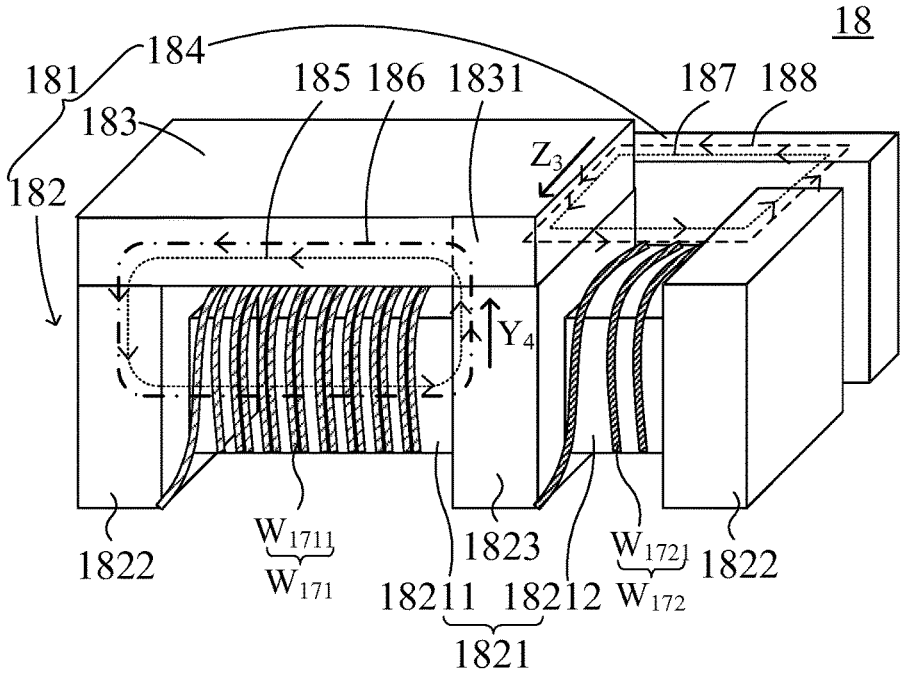
FIG. 18A is a perspective view illustrating a composite magnetic component meeting the equivalent circuit of FIG. 17.

Please refer to FIG. 18A, a perspective view illustrating a composite magnetic component meeting the equivalent circuit of FIG. 17. In this embodiment, the composite magnetic component 18 includes a magnetic flux-guiding unit 181, a first coil structure $W_{171}$ and a second coil structure $W_{172}$. The magnetic flux-guiding unit 181 includes a modified H shape core 182 (H-H shape core), a first plate 183 and a second plate 184. The modified H shape core 182 includes a bar 1821 and two flanges 1822 at two ends of the bar 1821. In addition, a protruding part 1823 is formed around the bar 1821 between the two flanges 1822. The protruding part 1823 separates the bar 1821 to form a first winding portion 18211 and a second winding portion 18212. The coil $W_{1711}$ of the first coil structure $W_{171}$ is wound around the first winding portion 18211, while the coil $W_{1721}$ of the second coil structure $W_{172}$ is wound around the second winding portion 18212. The first plate 183 is placed above the first winding portion 18211 between the left flange 1822 and the protruding part 1823. The second plate 184 is placed at a rear side of the second winding portion 18212 between the protruding part 1823 and the right flange 1822. The second plate 184 may be in contact with the protruding part 1823 and the right flange 1822 or connected to the protruding part 1823 and the right flange 1822 through a binder (not shown). The first magnetic paths 185 are closed loops covering the left portion of the bar 1821, the protruding part 1823, the first plate 183 and the left flange 1822. The second magnetic paths 187 are closed loops covering the right portion of the bar 1821, the right flange 1822, the second plate 184 and the protruding part 1823. The first magnetic flux 186 flows along the first magnetic paths 185, while the second magnetic flux 188 flows along the second magnetic paths 187. The first magnetic flux 186 and the second magnetic flux 188 orthogonally intersect within the magnetic flux-guiding unit 11. In particular, at all flux intersections within the protruding part 1823, the first magnetic flux 186 is orthogonal to the second magnetic flux 188. As shown in FIG. 18A, the first magnetic flux 186 flows along a direction $Y_4$ and the second magnetic flux 188 flows along a direction $Z_3$ within the protruding part 1823. Therefore, the signal interference between the first coil structure $W_{171}$ and the second coil structure $W_{172}$ is minimized. Hence, the two magnetic elements formed from the first coil structure $W_{171}$ and the second coil structure $W_{172}$ can function independently even though only one magnetic flux-guiding unit 181 is provided. Thus, compared with the conventional magnetic component including two magnetic flux-guiding units, the production cost, number of units and product size of the composite magnetic component according to the present disclosure are reduced. For example, the magnetic elements may be inductors.

If the second plate 184 is high enough to reach the first plate 183, the second magnetic paths 187 are closed loops covering the right portion of the bar 1821, the right flange 1822, the second plate 184, the protruding part 1823 and a portion 1831 of the first plate 183 on the protruding part 1823. Under this condition, the first magnetic flux 186 and the second magnetic flux 188 intersect at flux intersections within the protruding part 1823 and the portion 1831 of the first plate 183. At nearly all the flux intersections within the protruding part 1823 and the portion 1831 of the first plate 183, the first magnetic flux 186 is orthogonal to the second magnetic flux 188 (e.g. greater than 80%~99%). Only minor portions of the first magnetic flux 186 and the second magnetic flux 188 are not orthogonal to each other at the flux intersections within the portion 1831 of the first plate 183. For example, considering all of the flux intersections within the magnetic flux-guiding unit 181, less than 1%~20% of the first magnetic flux 186 at the flux intersections is not orthogonal to the second magnetic flux 188, and vice versa. The resultant magnetic coupling is less than 1%~20% so that the two magnetic elements are still substantially electrically independent.

Figure 18B:
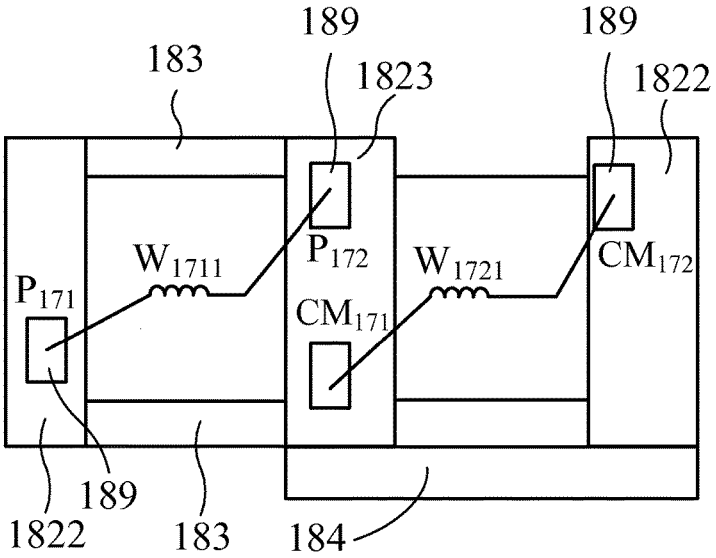
FIG. 18B is a schematic diagram illustrating electrical connections between the coils of the composite magnetic component of FIG. 18A.

Electrical connections between the coils $W_{1711}$ and $W_{1721}$ of the first coil structure $W_{171}$ and the second coil structure $W_{172}$ are shown in FIG. 18B. In this embodiment, a plurality of electrode units 189 are deposited on top surfaces or bottom surfaces of the flanges 1822 and the protruding part 1823 of the modified H shape core 182 of the magnetic flux-guiding unit 181. The electrode units 189 function as the first terminal $P_{171}$ of the first port, the second terminal $P_{172}$ of the first port, the first terminal $CM_{171}$ of the second port or the second terminal $CM_{172}$ of the second port to be electrically connected to the first coils $W_{1711}$ of the first coil structure $W_{171}$ or the second coil $W_{1721}$ of the second coil structure $W_{172}$.

According to the equivalent circuit of FIG. 17, two ends of the first coil $W_{1711}$ are electrically connected to two electrode units 189 representing the first terminal $P_{171}$ and the second terminal $P_{172}$ of the first port, respectively. Two ends of the second coil $W_{1721}$ are electrically connected to two electrode units 189 representing the first terminal $CM_{171}$ and the second terminal $CM_{172}$ of the second port, respectively.

According to the present disclosure, the first coil structure and the magnetic flux-guiding unit may form a pulse transformer, and the second coil structure and the magnetic flux-guiding unit may form a common-mode filter. The pulse transformer and the common-mode filter are used in an Ethernet cable access interface. In other embodiments, the combination of the first coil structure, the second coil structure and the magnetic flux-guiding unit may be output inductors of a multi-phase DC-to-DC converter. The output inductors may be, but are not limited, single coil inductors or dual-coil common mode chokes.

It is to be noted that the directions of the magnetic paths and the magnetic fluxes in each embodiment are not used to limit the present disclosure. Reversed current direction in the coils will result in the magnetic paths and the magnetic fluxes in opposite directions. It is to be noted that the direction-relative or dimension-relative terms, e.g. "right", "left", "top", "bottom", "front", "back", "leftwards", "rightwards", "downwards", "backwards", "lengthwise", "widthwise", "vertical", "horizontal", "long", "short" in the specification are given for illustration only, and they are not used to limit the directions/dimensions of the magnetic flux-guiding units of the composite magnetic components or the directions of the magnetic paths/fluxes. Similar modifications are still included within the scope of the present disclosure.

In conclusion, the composite magnetic component according to the present disclosure includes a first coil structure and a second coil structure, both of which are wound around different portions of a single common magnetic flux-guiding unit. The first coil structure and the magnetic flux-guiding unit result in a first magnetic flux, while the second coil structure and the magnetic flux-guiding unit result in a second magnetic flux. The first magnetic flux and the second magnetic flux are orthogonal to each other within the magnetic flux-guiding unit. In particular, the first magnetic flux and the second magnetic flux mainly or entirely orthogonally intersect at the flux intersections within the magnetic flux-guiding unit. For example, 80%~100% of the first magnetic flux at the flux intersections within the magnetic flux-guiding unit is orthogonal to 80%~100% of the second magnetic flux at the flux intersections. According to the present disclosure, the two magnetic elements function substantially independently even though only one single magnetic flux-guiding unit is utilized. Thus, the composite magnetic component with compact size is provided and the production cost thereof is significantly reduced.

While the disclosure has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A composite magnetic component comprising:

a magnetic flux-guiding unit having a first winding portion and a second winding portion;

a first coil structure wound around the first winding portion of the magnetic flux-guiding unit, a first magnetic flux resulting from the first coil structure and the magnetic flux-guiding unit; and a second coil structure wound around the second winding portion of the magnetic flux-guiding unit, a second magnetic flux resulting from the second coil structure and the magnetic flux-guiding unit, wherein the first magnetic flux and the second magnetic flux intersect at flux intersections within the magnetic flux-guiding unit, at least a portion of the first magnetic flux at the flux intersections being orthogonal to at least a portion of the second magnetic flux at the flux intersections, wherein the magnetic flux-guiding unit comprises:

a modified H shape core having a first flange, a second flange, a bar connected between the two flanges, and a protruding part formed around the bar, the protruding part having an upper surface and a lateral surface orthogonal to each other;

a first plate horizontally placed on an upper side of a portion of the modified H shape core between the first flange and the protruding part, and covering the upper surface of the protruding part; and a second plate vertically placed at a lateral side of another portion of the modified H shape core between the protruding part and the second flange, and covering the lateral surface of the protruding part, the second plate being orthogonal to the first plate, wherein the first winding portion comprises a portion of the bar between the first flange and the protruding part; the second winding portion comprises another portion of the bar between the second flange and the protruding part; the first magnetic flux in the protruding part flows along a first direction and flows towards or away from the first plate through the upper surface of the protruding part along the first direction; and the second magnetic flux in the protruding part flows along a second direction orthogonal to the first direction and flows towards or away from the second plate through the lateral surface of the protruding part along the second direction, wherein the first winding portion, the first flange and the protruding part define a first opening located at the lateral side between the first flange and the protruding part and form a first open magnetic path orthogonal to the first direction in the protruding part; and the second winding portion, the second flange and the protruding part define a second opening located at the upper side between the second flange and the protruding part and form a second open magnetic path orthogonal to the second direction in the protruding part.

2. The composite magnetic component according to claim 1, wherein the first coil structure comprises a first coil and a second coil, and the second coil structure comprises a third coil and a fourth coil, wherein two ends of the first coil are electrically connected to a first terminal and a second terminal of a first port, respectively; two ends of the second coil are electrically connected to a first node and a second node, respectively; two ends of the third coil are electrically connected to the first node and a first terminal of a second port, respectively; and two ends of the fourth coil are electrically connected to the second node and a second terminal of the second port, respectively.

3. The composite magnetic component according to claim 1, wherein the first coil structure comprises a first coil, a second coil, a third coil and a fourth coil, and the second coil structure comprises a fifth coil and a sixth coil, wherein two ends of the first coil are electrically connected to a first terminal of a first port and a first center tap, respectively; two ends of the second coil are electrically connected to a second terminal of the first port and the first center tap, respectively; two ends of the third coil are electrically connected to a first node and a second center tap, respectively; two ends of the fourth coil are electrically connected to a second node and the second center tap, respectively; two ends of the fifth coil are electrically connected to the first node and a first terminal of a second port, respectively; and two ends of the sixth coil are electrically connected to the second node and a second terminal of the second port, respectively.

4. The composite magnetic component according to claim 3 wherein winding directions of the first coil and the second coil are the same, and winding directions of the third coil and the fourth coil are the same.

5. The composite magnetic component according to claim 1, wherein the at least a portion ranges from 80% to 100%.

* * * * *